US009890579B2

(12) United States Patent
Ouellette

(10) Patent No.: US 9,890,579 B2
(45) Date of Patent: Feb. 13, 2018

(54) STORAGE CONTAINER, STORAGE CABINET AND STORAGE SYSTEM

(71) Applicant: Gestion Marc-Noël Ouellette Inc., Boisbriand (CA)

(72) Inventor: Marc-Noël Ouellette, Boisbriand (CA)

(73) Assignee: GESTION MARC-NOEL OUELLETTE INC., Boisbriand (CA)

( * ) Notice: Subject to any disclaimer, the term of this patent is extended or adjusted under 35 U.S.C. 154(b) by 0 days.

(21) Appl. No.: 14/314,392

(22) Filed: Jun. 25, 2014

(65) Prior Publication Data

US 2014/0374418 A1 Dec. 25, 2014

Related U.S. Application Data

(60) Provisional application No. 61/839,082, filed on Jun. 25, 2013.

(51) Int. Cl.

| | |
|---|---|
| ***B65D 19/44*** | (2006.01) |
| ***E06B 5/00*** | (2006.01) |
| ***B65D 51/18*** | (2006.01) |
| ***B65D 21/02*** | (2006.01) |
| ***B65D 43/02*** | (2006.01) |
| ***B65D 47/12*** | (2006.01) |

(52) U.S. Cl.

CPC ..... *E06B 5/006* (2013.01); *B65D 21/0222* (2013.01); *B65D 43/0231* (2013.01); *B65D 47/122* (2013.01); *B65D 51/18* (2013.01); *B65D 2543/00092* (2013.01); *B65D 2543/00527* (2013.01); *B65D 2543/00537* (2013.01)

(58) Field of Classification Search

CPC ..... B65D 2543/00537; B65D 2543/00092; B65D 2543/00527; B65D 21/0202; B65D 21/0222; B65D 51/18; B65D 47/122; B65D 43/0231; E06B 5/006

USPC ..... 312/245, 294, 326; 220/254.3; 206/509, 206/219

See application file for complete search history.

(56) References Cited

U.S. PATENT DOCUMENTS

| | | | | | |
|---|---|---|---|---|---|
| 1,901,861 | A * | 3/1933 | Baker | B44D 3/04 | 206/1.9 |
| 2,663,450 | A * | 12/1953 | Bourcart | A45D 40/00 | 206/499 |
| 3,091,361 | A * | 5/1963 | Gawron | B65D 21/0219 | 206/508 |
| 3,278,007 | A * | 10/1966 | Weber | B44D 3/04 | 206/1.8 |
| 3,942,669 | A * | 3/1976 | Savage, Jr. | A62C 13/78 | 169/51 |

(Continued)

*Primary Examiner* — Daniel J Troy
*Assistant Examiner* — Timothy M Ayres
(74) *Attorney, Agent, or Firm* — Benoit & Cote Inc.

(57) ABSTRACT

The present document describes a storage cabinet and a storage system for storing a liquid and/or a granulate matter. The storage system includes at least one storage container for storing the liquid and/or the granulate matter. The storage container includes a container body with a main access, a main lid removably mounted to the container body for covering the main access and a secondary lid removably mounted to the container body and/or the main lid for covering a secondary access on the container body and/or the main lid, where the container body includes a top portion and a bottom portion adapted for stacking. The storage system further includes a storage cabinet with a floor member which includes a stacking element for receiving the bottom portion of the container body.

11 Claims, 28 Drawing Sheets

(56) References Cited

U.S. PATENT DOCUMENTS 4,362,250 A * 12/1982 Cottingham ..... B65D 1/023 206/525
4,561,705 A * 12/1985 Schafer ..... B25H 3/023 220/4.22
4,632,268 A * 12/1986 Melzi ..... B65D 81/36 206/508
4,690,271 A * 9/1987 Zak ..... B44D 3/04 206/1.7
4,838,448 A * 6/1989 Piano ..... B65D 17/163 220/257.2
5,377,858 A * 1/1995 Morris, Sr. ..... B65D 50/046 206/506
D373,512 S * 9/1996 Hong ..... D7/592
5,669,526 A 9/1997 Keyfauver
5,709,314 A * 1/1998 Petry ..... B65D 21/0222 206/508
5,887,740 A * 3/1999 Hong ..... B65D 21/0231 206/508
6,619,474 B2 * 9/2003 Montgomery ..... B44D 3/04 206/1.5
7,445,113 B2 11/2008 Wilhelm
8,328,014 B2 * 12/2012 Saunders ..... B65D 77/0486 206/426
2003/0111497 A1 6/2003 Lukaris
2006/0283756 A1 12/2006 Wylie
2007/0108084 A1 5/2007 Randall et al.
2008/0128457 A1 6/2008 Bravo et al.
2009/0038271 A1 2/2009 Nottingham et al.
2011/0100856 A1 * 5/2011 Rosko ..... B65D 21/0231 206/504
2012/0138492 A1 * 6/2012 Gruber ..... B42F 7/14 206/232
2013/0008897 A1 * 1/2013 Rusnak ..... B65D 43/0231 220/23.89

* cited by examiner

STORAGE CONTAINER, STORAGE CABINET AND STORAGE SYSTEM

CROSS-REFERENCE TO RELATED APPLICATIONS

This application claims priority under 35 U.S.C. § 119(e) of U.S. provisional patent application No. 61/839,082 filed on Jun. 25, 2013, the specification of which is hereby incorporated by reference.

BACKGROUND (a) Field

The subject matter disclosed generally relates to storage containers, storage cabinets and storage systems. More particularly, the subject matter relates to storage containers, storage cabinets and storage systems for storing liquids (i.e., such as paint, varnish liquids, polish liquids, dye products, chemical products, etc.).

(b) Related Prior Art

It is usually inconvenient to store left over liquid containers such as paint containers, varnish containers and the like. These paint containers can take a non negligible volume in a room and are not very esthetic.

Containers used to store liquids or fluids (i.e., such as paint, varnish liquids, polish liquids, dye products, chemical products, etc.) generally have a body with a removable attached lid for closing off the body (i.e., paint can or paint container). The body typically houses a handle or secures a pail-like handle for grasping. The lids generally are secured to the container by threads and prevent paint from leaking, spilling and/or drying. Some containers have specially designed spouts engineered into the container opening for substantially drip less dispensing. Others, considering the possibility of dried paint gathering on and binding up the threads, have taken special measures to insure easier removal of the lid. These include special handles attached to or molded into the lid giving the user some mechanical advantage to overcome thread binding. Still, some stacking construction measures have been taken to allow these containers to be stacked, one on top of the other.

One disadvantage of the conventional paint or liquid container is that its design fails to consider how a user actually uses the container. In particular, users often forego using a paint tray (or a liquid tray) in place of simply using the paint or liquid container to paint or apply the liquid via quick touch-up jobs. This poses a problem that vexes users of the conventional paint or liquid container. It is not unusual for paint or liquid to drip onto the threads or the interface between the lid and the container. Over time, the paint or liquid collects and the lid becomes increasingly difficult to remove or attach. Thus, the conventional paint or liquid container does not have special provisions to accommodate use for quick touch-up jobs.

Another convenience conventional paint or liquid containers fail to realize is a stable stacking construction. Conventional containers typically have a receptacle rib and cover recess construction for stacking. Even so, these containers exhibit poor stability when only a few are stacked on top of each other. Densities nearing 13 pounds per gallon for a typical paint, warrant consideration for an alternative stacking construction.

There exists on the market paint and touch-up containers. However, there is a need for a storage system which would contain the plurality of stackable paint or liquid containers which would be easy to use, cheap to market and user friendly for someone using the containers.

For example, U.S. Patent Publication no. 2007/0108084 to Randall et al. describes a paint storage and touch-up container that is specifically designed for storing architectural paint. However, there is a need for a storage system which would receive such paint storage containers and corresponding material (i.e., paintbrushes, paint rolls, brushes and the like) for allowing a user to quickly touch up spots to be recovered and the like.

Furthermore, there are usually an important number of containers in a garage for example, where each of them only contains a small volume of paint.

There is therefore a need for improved storage containers and for improved storage systems to receive such storage containers.

SUMMARY

According to an embodiment, there is provided a storage system for storing at least one of a liquid and a granulate matter, the storage system comprising: at least one storage container for receiving the at least one of the liquid and the granulate matter comprising: a container body having a main access; a main lid removably mounted to the container body for covering the main access; and a secondary lid removably mounted to one of the container body and the main lid for covering a secondary access on the one of the container body and the main lid; wherein the container body comprises a top portion and a bottom portion adapted for stacking; and a storage cabinet having a floor member comprising a stacking element for stackably receiving the bottom portion of the container body.

According to another embodiment, the container body comprises a substantially flat bottom wall having a stacking member configured for stacking with the main lid of another one of the at least one storage container and the stacking element on the floor member of the storage cabinet.

According to a further embodiment, the secondary lid is removably mounted to the main lid for covering the secondary access on the main lid.

According to yet another embodiment, the stacking member comprises a circular recess on a periphery of the substantially flat bottom wall and the main lid comprises a circular outwardly projecting surface on a corresponding periphery of the main lid for releasably interfacing with the circular recess.

According to another embodiment, the stacking element comprises another circular outwardly projecting surface for releasably interfacing with the circular recess for stackably receiving the bottom portion of the container body.

According to a further embodiment, the circular recess on the periphery and the circular outwardly projecting surfaces each comprise circular threads for interfacing with each other.

According to yet another embodiment, the secondary lid comprises a top surface below the circular outwardly projecting surface, for receiving the substantially flat bottom wall of the container body.

According to another embodiment, the main lid further comprises a recess between the secondary lid and the circular outwardly projecting surface.

According to a further embodiment, the floor member comprises a plurality of stacking elements for receiving a plurality of storage containers.

According to yet another embodiment, the storage cabinet further comprises a separation wall substantially perpendicular to and extending upwardly from the floor member, for separating at least two of the plurality of stacking elements.

According to another embodiment, the storage cabinet further comprises at least one of a door member, a handle member, a mounting system for at least one of mounting more than one storage cabinets together, and mounting a storage cabinet to a wall surface, and an identification member for identifying the at least one of the liquid and the granulate member contained in one storage container.

According to another embodiment, there is provided a storage container for storing at least one of a liquid and a granulate matter, the storage container comprising: a container body for receiving the at least one of the liquid and the granulate matter, the container body having a main access, a substantially flat bottom wall and a stacking member on the substantially flat bottom wall; a main lid removably mounted to the container body for covering the main access; and a secondary lid removably mounted to one of the container body and the main lid for covering a secondary access on the one of the container body and the main lid; wherein the stacking member on the substantially flat bottom wall is adapted for stacking with the main lid of another storage container and a stacking element on a floor member of a storage cabinet.

According to a further embodiment, the secondary lid is removably mounted to the main lid for covering the secondary access on the main lid.

According to yet another embodiment, the stacking member comprises a circular recess on a periphery of the substantially flat bottom wall and wherein the main lid comprises a circular outwardly projecting surface on a corresponding periphery of the main lid for releasably interfacing with the circular recess.

According to another embodiment, the circular recess on the periphery of the substantially flat bottom wall of the container body comprises circular threads and wherein the circular outwardly projecting surface on the corresponding periphery of the main lid comprises corresponding circular threads for releasably interfacing with the circular threads.

According to a further embodiment, the secondary lid comprises a top surface below the circular outwardly projecting surface, for receiving the substantially flat bottom wall of the container body.

According to yet another embodiment, the main lid further comprises a recess between the secondary lid and the circular outwardly projecting surface.

According to another embodiment, the main lid and the secondary lid are threaded lids.

According to a further embodiment, the main lid and the container body are removably mounted in a first direction of rotation and wherein the secondary lid and the main lid are removably mounted in a second direction of rotation.

According to yet another embodiment, at least one of the container body and the main lid comprises an identification member for identifying the at least one of the liquid and the granulate member.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
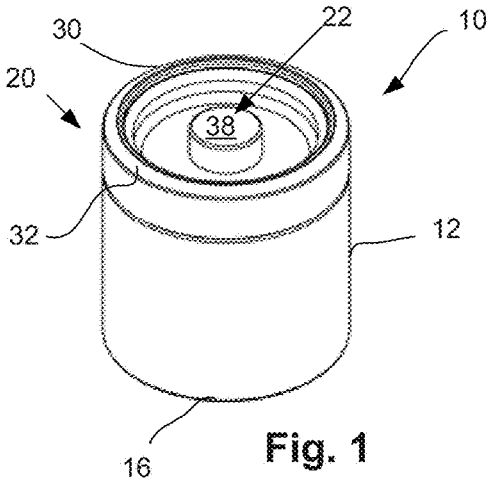
FIG. 1 is a top perspective view of a storage container in accordance with an embodiment.
Figure 2:
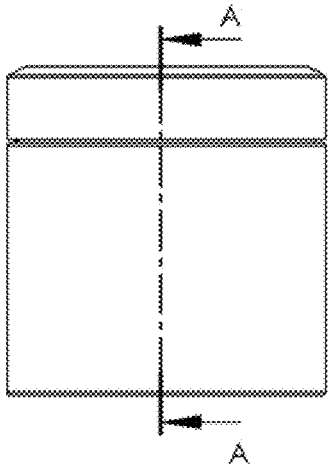
FIG. 2 is an elevation view of the storage container of FIG. 1.
Figure 3:
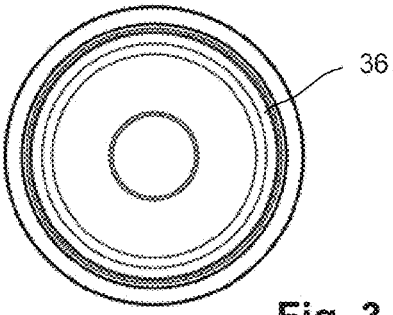
FIG. 3 is a top plan view of the storage container of FIG. 1.
Figure 4:
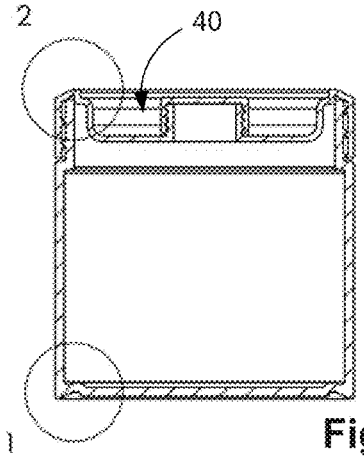
FIG. 4 is a cross-sectional view taken along line A-A of the storage container in accordance with another embodiment.
Figure 5:
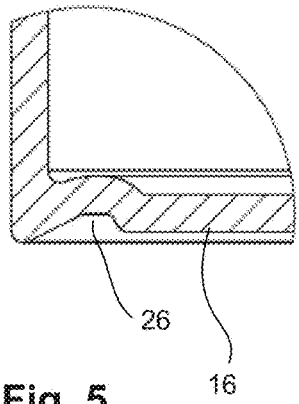
FIG. 5 is a close-up view of section 1 of the storage container of FIG. 4.
Figure 6:
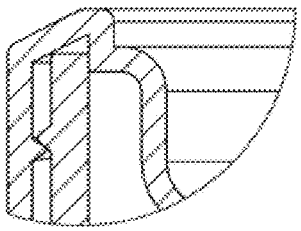
FIG. 6 is a close-up view of section 2 of the storage container of FIG. 4.
Figure 7:
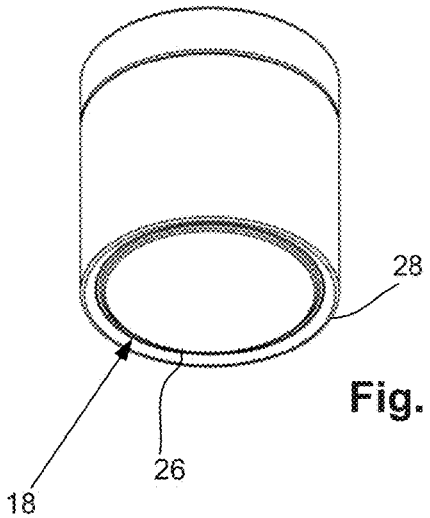
FIG. 7 is a bottom perspective view of the storage container of FIG. 1.
Figure 8:
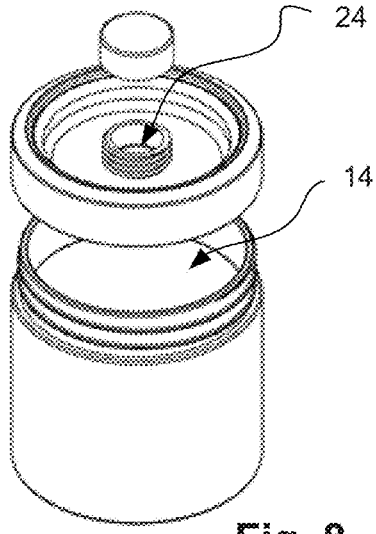
FIG. 8 is a top perspective exploded view of the storage container of FIG. 1.
Figure 9:
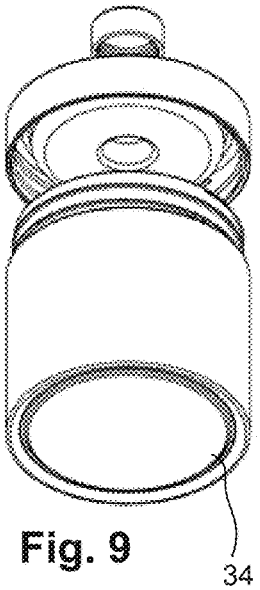
FIG. 9 is a bottom perspective exploded view of the storage container of FIG. 1.
Figure 10:
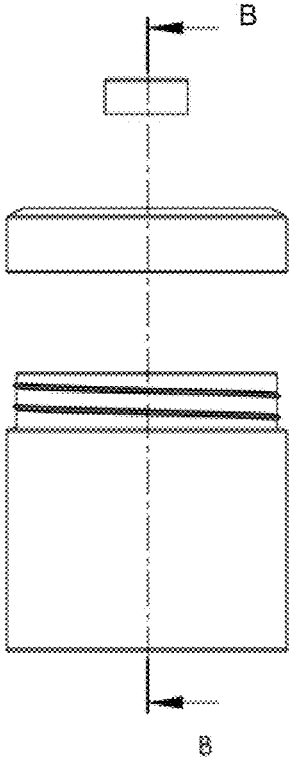
FIG. 10 is an elevation exploded view of the storage container of FIG. 1.
Figure 11:
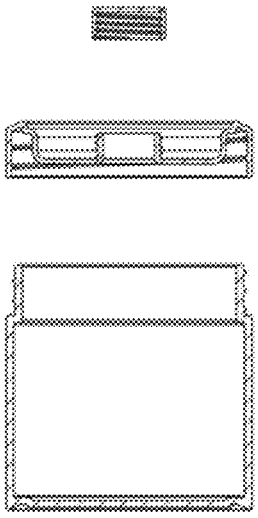
FIG. 11 is a cross-sectional exploded view taken along line B-B of the storage container of FIG. 1.
Figure 12:
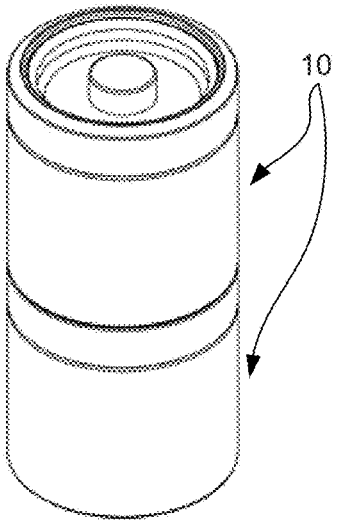
FIG. 12 is a top perspective view of two stacked storage containers in accordance with another embodiment.
Figure 13:
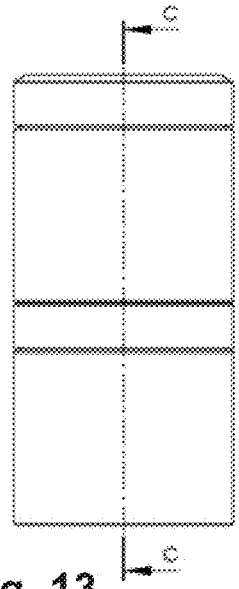
FIG. 13 is an elevation view of the two stacked storage containers of FIG. 12.
Figure 14:
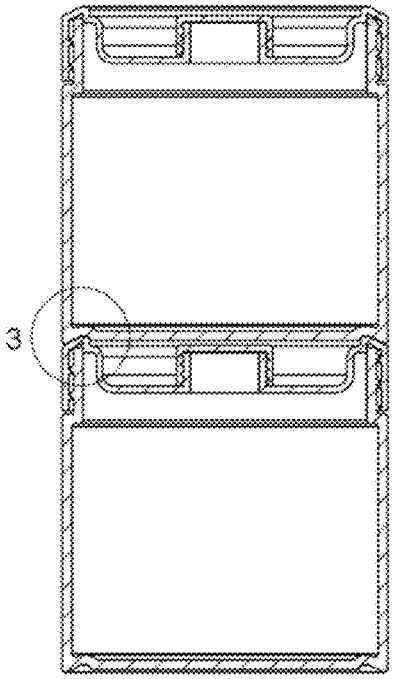
FIG. 14 is a cross-sectional view taken along line C-C of the two stacked storage containers of FIG. 13.
Figure 15:
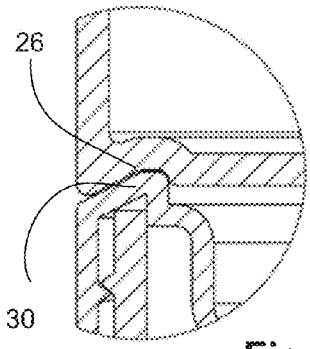
FIG. 15 is a close-up view of section 3 of the two stacked storage containers of FIG. 14.
Figure 16:
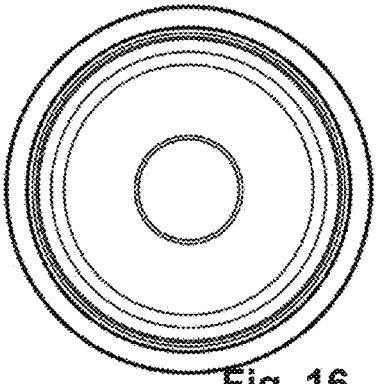
FIG. 16 is a top plan view of the two stacked storage containers of FIG. 12.
Figure 17:
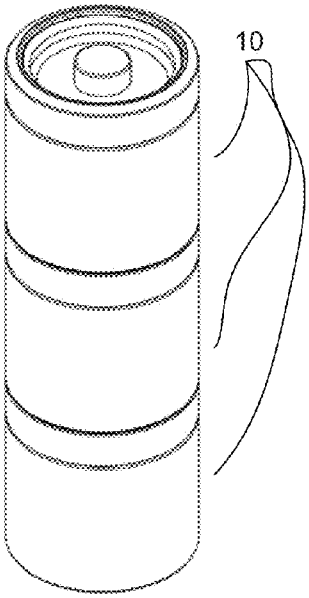
FIG. 17 is a top perspective view of three stacked storage containers in accordance with another embodiment.
Figure 18:
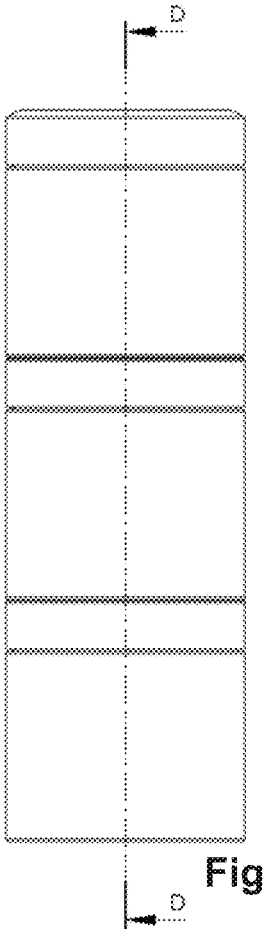
FIG. 18 is an elevation view of the three stacked storage containers of FIG. 17.
Figure 19:
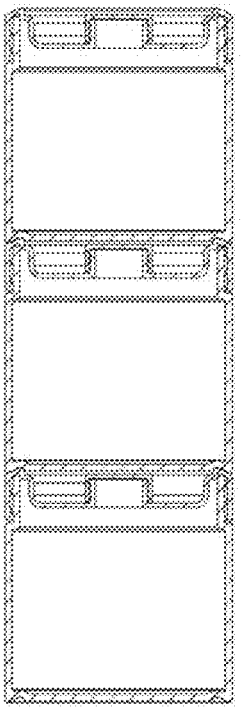
FIG. 19 is a cross-sectional view taken along line D-D of the three stacked storage container of FIG. 18.
Figure 20:
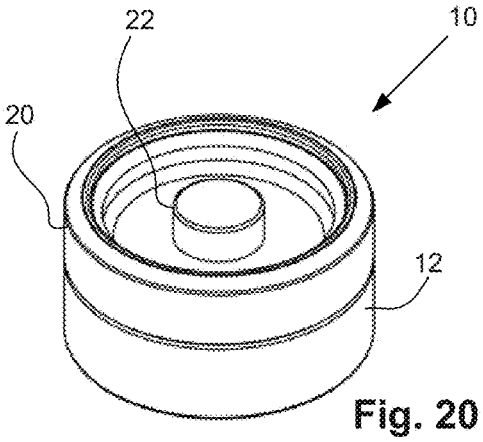
FIG. 20 is a top perspective view of a storage container in accordance with another embodiment.
Figure 21:
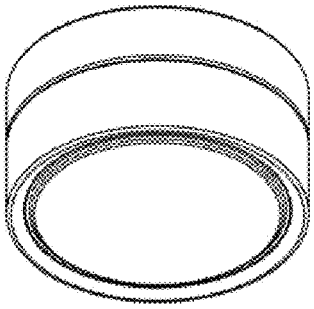
FIG. 21 is a bottom perspective view of the storage container of FIG. 20.
Figure 22:
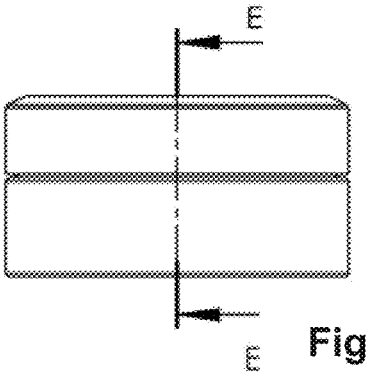
FIG. 22 is an elevation view of the storage container of FIG. 20.
Figure 23:
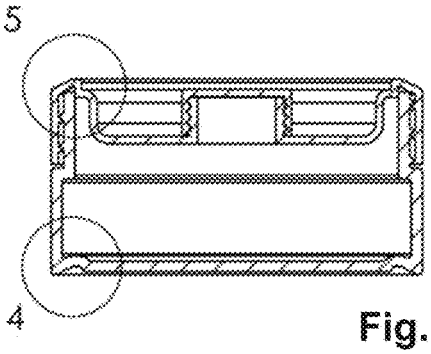
FIG. 23 is a cross-sectional view taken along line E-E of the storage container of FIG. 22.
Figure 24:
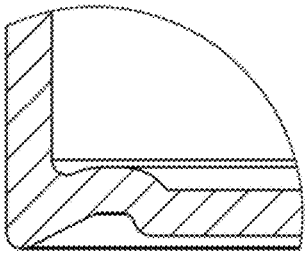
FIG. 24 is a close-up view of section 4 of the storage container of FIG. 23.
Figure 25:
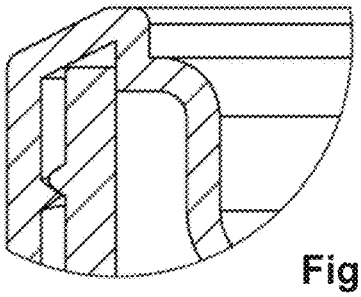
FIG. 25 is a close-up view of section 5 of the storage container of FIG. 23.
Figure 26:
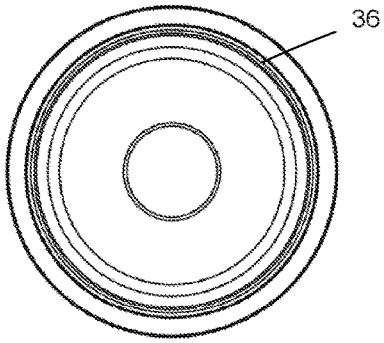
FIG. 26 is a top plan view of the storage container of FIG. 20.
Figure 27:
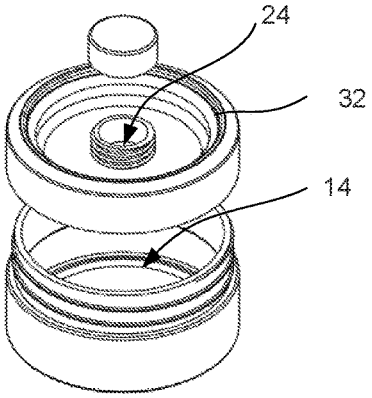
FIG. 27 is a top perspective exploded view of the storage container of FIG. 20.
Figure 28:
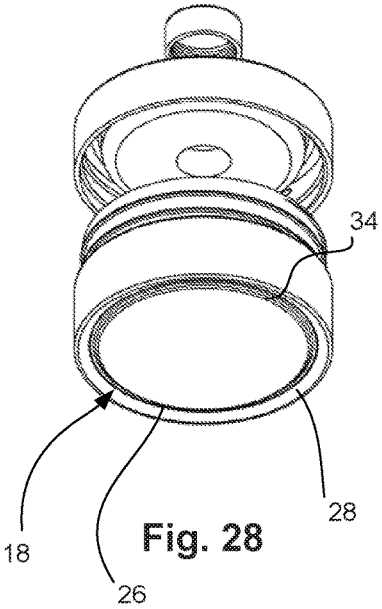
FIG. 28 is a bottom perspective exploded view of the storage container of FIG. 20.
Figure 29:
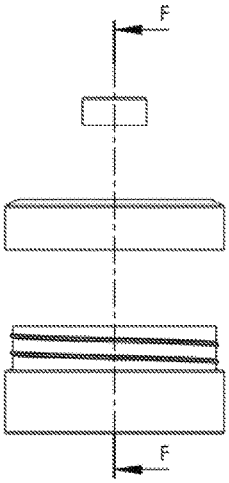
FIG. 29 is an elevation exploded view of the storage container of FIG. 20.
Figure 30:
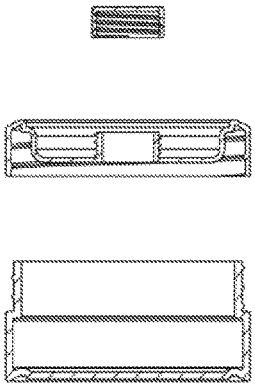
FIG. 30 is a cross-sectional view taken along line F-F of the storage container of FIG. 29.
Figure 31:
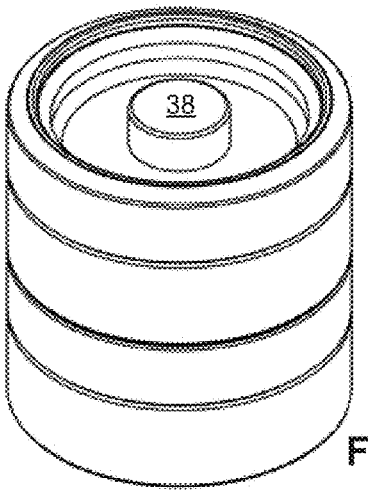
FIG. 31 is a top perspective view of two stacked storage containers in accordance with another embodiment.
Figure 32:
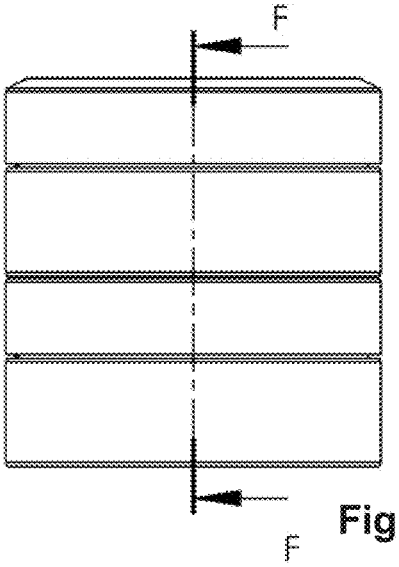
FIG. 32 is an elevation view of the two stacked storage containers of FIG. 31.
Figure 33:
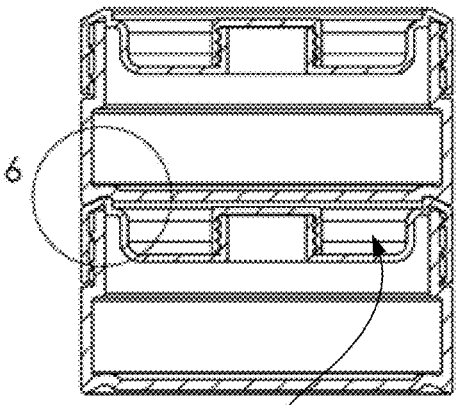
FIG. 33 is a cross-sectional view taken along line G-G of the two stacked storage containers of FIG. 32.
Figure 34:
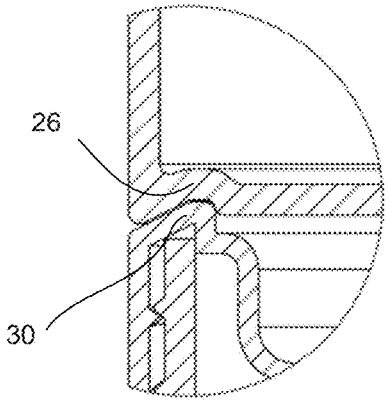
FIG. 34 is a close-up view of section 6 of the two stacked storage containers of FIG. 33.
Figure 35:
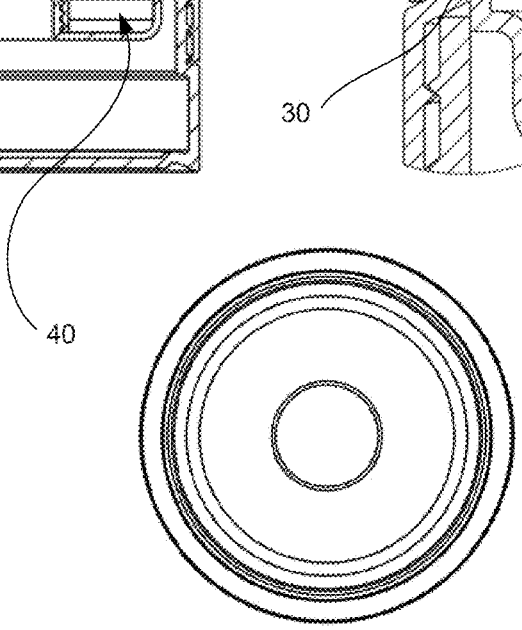
FIG. 35 is a top plan view of the two stacked storage containers of FIG. 31.
Figure 36:
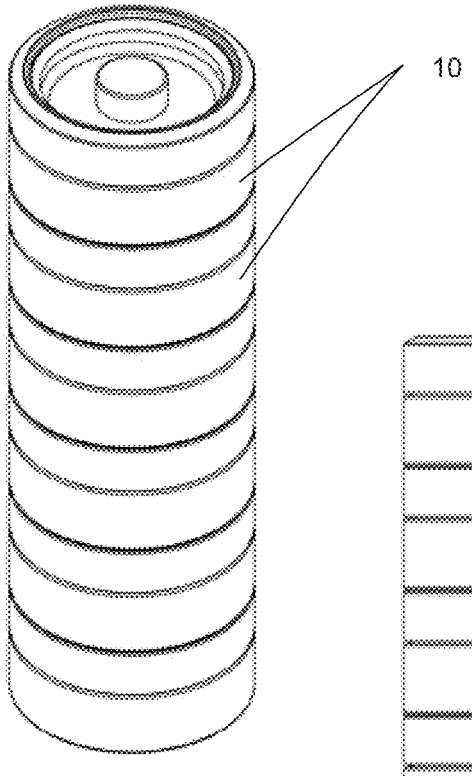
FIG. 36 is a top perspective view of six stacked storage containers in accordance with another embodiment.
Figure 37:
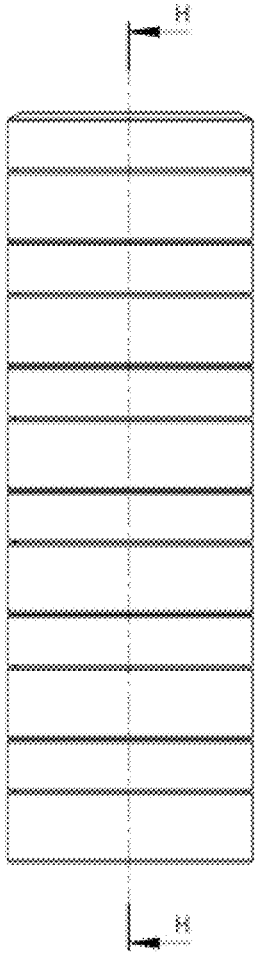
FIG. 37 is an elevation view of the six stacked storage containers of FIG. 36.
Figure 38:
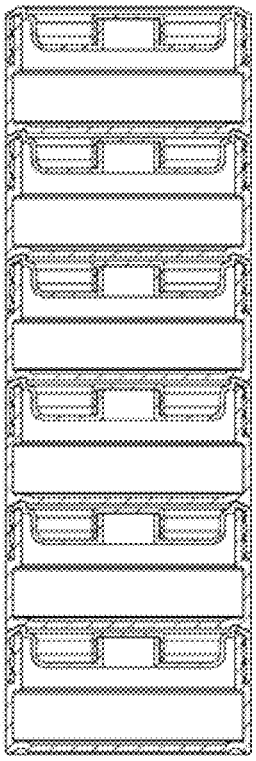
FIG. 38 is a cross-sectional view taken along line H-H of the six stacked storage containers of FIG. 37.
Figure 39:
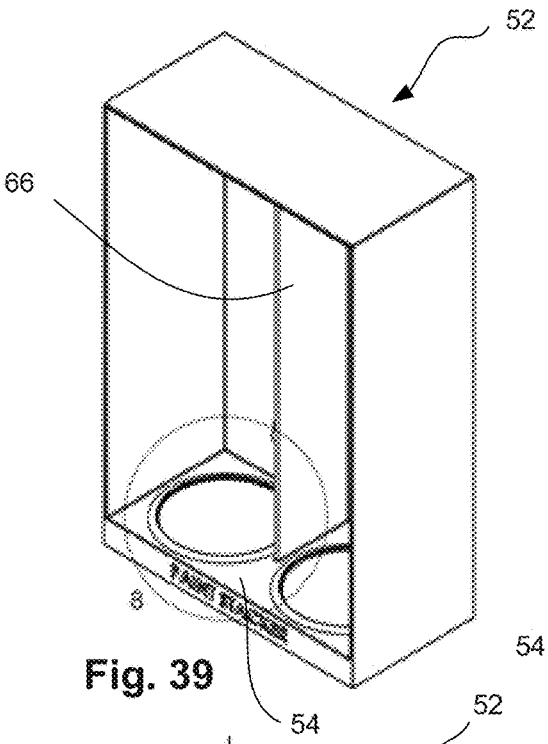
FIG. 39 is a top perspective view of a storage cabinet in accordance with another embodiment.
Figure 40:
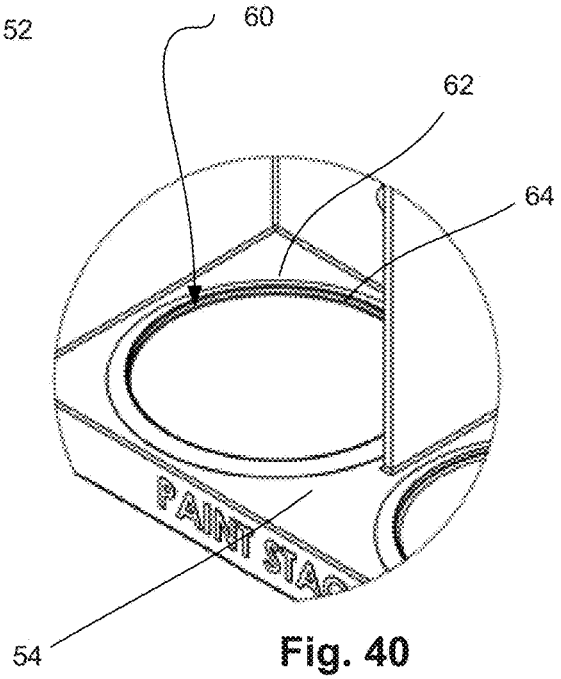
FIG. 40 is a close-up view of section 8 of the storage cabinet of FIG. 39.
Figure 41:
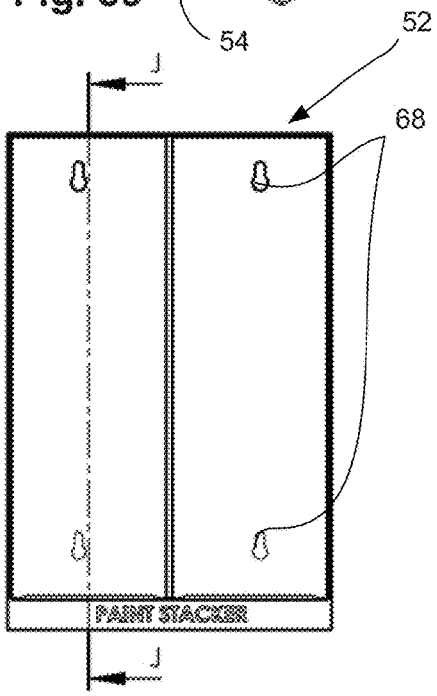
FIG. 41 is a front elevation view of the storage cabinet of FIG. 39.
Figure 42:
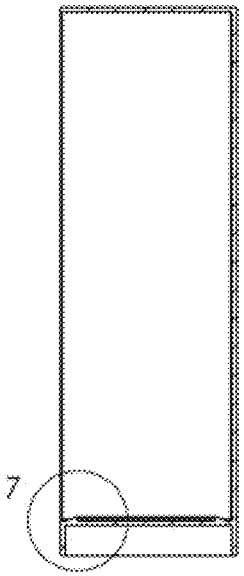
FIG. 42 is a cross-sectional view taken along line J-J of the storage cabinet of FIG. 41.
Figure 43:
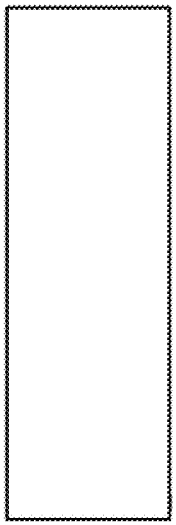
FIG. 43 is a side elevation view of the storage cabinet of FIG. 39
Figure 44:
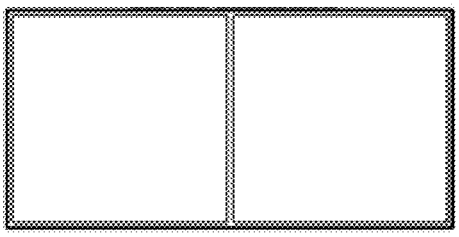
FIG. 44 is a top plan elevation view of the storage cabinet of FIG. 39.
Figure 45:
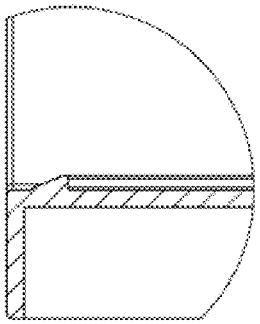
FIG. 45 is a close-up view of section 7 of the storage cabinet of FIG. 42.
Figure 46:
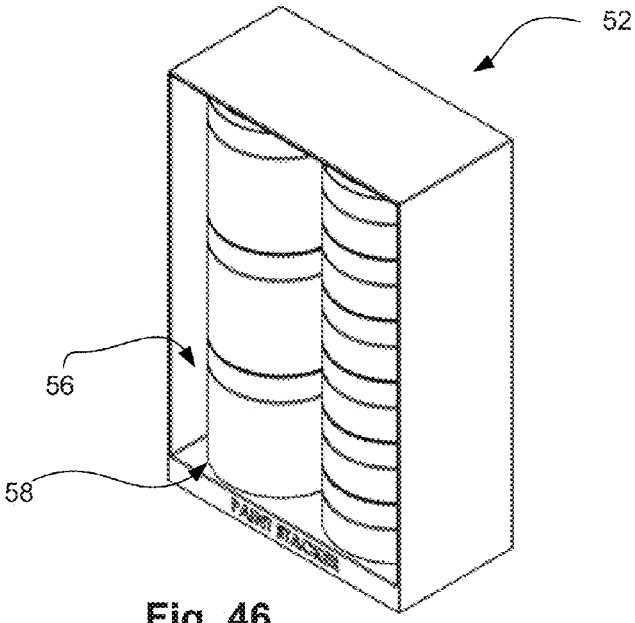
FIG. 46 is a top perspective view of a storage system in accordance with another embodiment.
Figure 47:
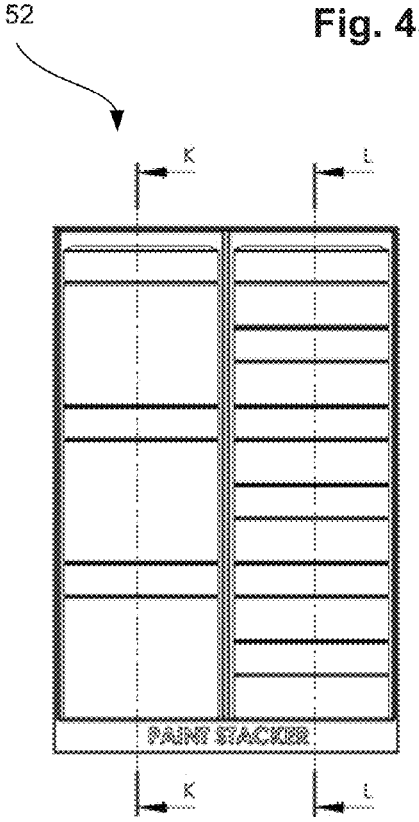
FIG. 47 is a front elevation view of the storage system of FIG. 46.
Figure 48:
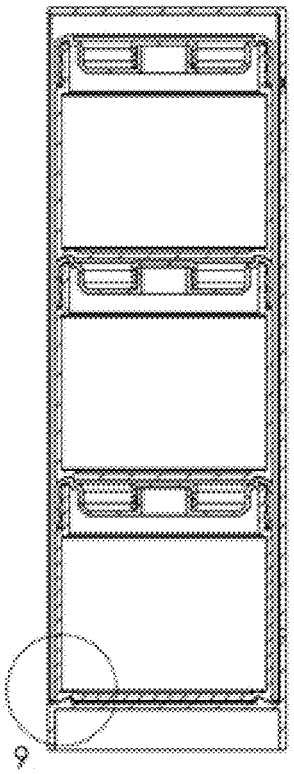
FIG. 48 is a cross-sectional view taken along line K-K of the storage system of FIG. 47.
Figure 49:
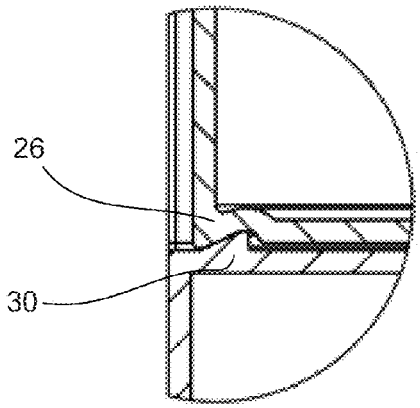
FIG. 49 is a close-up view of section 9 of the storage system of FIG. 48.
Figure 50:
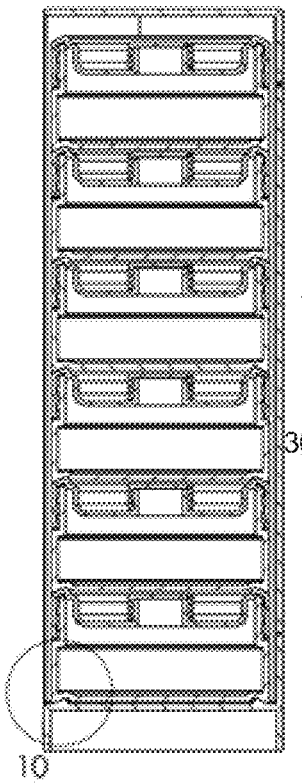
FIG. 50 is a cross-sectional view taken along line L-L of the storage system of FIG. 47.
Figure 51:
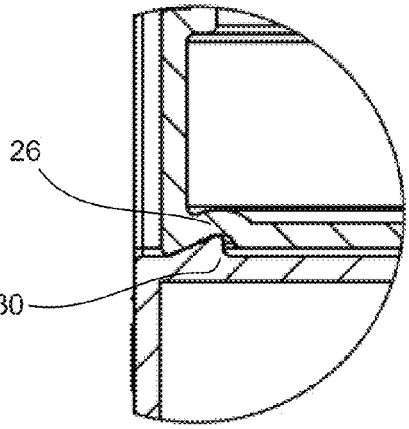
FIG. 51 is a close-up view of section 10 of the storage system of FIG. 50.

In embodiments there are disclosed storage containers, storage cabinets and storage systems.

According to an embodiment and referring now to FIGS. 1-38, there is shown a storage container 10 for storing liquids and/or a granulate matters (i.e., paint, varnish liquids, polish liquids, dye products, chemical products, and the like). The storage container 10 includes a container body 12 for storing the liquids and/or the granulate matters. The container body 10 has a main access 14, a substantially flat bottom wall 16 and a stacking member 18 on the substantially flat bottom wall 16. The storage container further includes a main lid 20 which is removably mounted to the container body 12 for covering the main access 14. The storage container 10 further includes a secondary lid 22 which is removably mounted to the container body 12 or the main lid 20 for covering a secondary access 24 on the container body 12 or the main lid 20. As shown in FIGS. 1-38, the secondary lid 22 is removably mounted, or to be removably mounted to, the main lid 20. It is to be noted that the stacking member 18 on the substantially flat bottom wall 16 is adapted for stacking with the main lid 20 of another storage container 10 (as shown in FIGS. 12, 13, 14, 17, 18, 19, 31, 32, 33, 34, 36, 37 and 38) and a stacking element 60 on a floor member 54 of a storage cabinet 52. This last feature will be described in more details below.

As mentioned above, according to FIGS. 1-38, the secondary lid 22 is removably mounted to the main lid 20 for covering the secondary access 24 on the main lid 20. As better shown in FIGS. 1, 3, 5, 6, 7, 8, 9, 12, 14, 15, 16, 17, 19, 27, 28, 20, 21, 23, 24, 25, 31, 33, 34, 35, 36 and 38, the stacking member 18 includes a circular recess 26 on a periphery 28 of the substantially flat bottom wall 16. Furthermore, the main lid 20 includes a circular outwardly projecting surface 30 on a corresponding periphery 32 of the main lid 20 for releasably interfacing with the circular recess 26.

As shown in FIGS. 1, 3, 5, 6, 7, 8, 9, 12, 14, 15, 16, 17, 19, 27, 28, 20, 21, 23, 24, 25, 31, 33, 34, 35, 36 and 38, the circular recess 26 on the periphery 28 of the substantially flat bottom wall 16 of the container body 12 includes circular threads 34 and the circular outwardly projecting surface 30 on the corresponding periphery 32 of the main lid 20 includes corresponding circular threads 36 for releasably interfacing with the circular threads 34. The threads 34, 36 provide an interaction with the substantially flat bottom wall 16 and the main lid 20 of adjacent storage containers 10 to provide the stackability function.

According to other embodiment, it is to be noted that the circular recess 26 on the substantially flat bottom wall 16 and the circular outwardly projecting surface 30 on the main lid 20 may be replaced by other conventional mating connectors that would provide the stackability to the storage containers 10. For example, the substantially flat bottom wall 16 may include one or more mating connector(s) (not shown) that would releasably connect with one or more corresponding connector(s) on the main lid 20, such as to provide the stackability to the storage containers 10.

As shown in FIGS. 1, 4, 11, 12, 14, 17, 19, 20, 23, 30, 31, 33, 36 and 38, the secondary lid 22 comprises a top surface 38 which is below the circular outwardly projecting surface 30 for receiving the substantially flat bottom wall 16 of the container body 12. This configuration of the secondary lid 22 on the main lid 20 allows a first storage container 10 to be stacked above a second storage container 10 without interfering with the secondary lid 22 of the first storage container 10 which is below and provides the stackability function.

As shown in FIGS. 1, 4, 11, 12, 14, 17, 19, 20, 23, 30, 31, 33, 36 and 38, the main lid 20 of the storage container 10 further includes a recess 40 between the secondary lid 22 and the circular outwardly projecting surface 30. Thus, excess of liquids and/or excess of granulate matters may accidentally spill out the storage container 10 without dirtying the external environment (i.e., the floor, a furniture and the like). For example, when a user opens the secondary lid 22 to access the liquids and/or the granulate matters that is contained in the storage container 10, he may pour some liquid around the secondary lid 22. Thus, according to the configuration of the recess 40, this poured liquid will be recuperated into the recess 40 defined between the secondary lid 22 and the circular outwardly projecting surface 30, but not on the floor, on the table, or around the storage container 10 and touch-up painting may be achieved easily and without damages to the external environment.

As better shown in FIGS. 8, 9, 10, 11, 27, 28 and 30, the main lid 20 and the secondary lid 22 are threaded lids to provide airtightness between the liquids and/or granulate matters contained in the storage container 10 and the external environment. Accordingly, the conservation of the liquids and/or granulate matters contained in the storage container 10 is provided.

According to one embodiment, the main lid 20 and the container body 12 may be removably mounted in a first direction of rotation and the secondary lid 22 and the main lid 20 may be removably mounted in a second direction of rotation. For example, the main lid 20 and the container body 12 may be removably mounted in a clockwise direction of rotation and the secondary lid 22 and the main lid 20 may be removably mounted in a counterclockwise direction of rotation for an easy utilization of the storage container 10 by the user.

According to one embodiment, the container body 12 and/or the main lid 20 may further include an identification member (not shown) for identifying the liquid and/or the granulate member. The identification member may include information such as to allow a user to remember which liquid/granulate matter is contained in which storage container 10. The information may include the name of the liquid/granulate member, the characteristics of the liquid/granulate member, the date of purchase of the granulate matter, the color/texture/finish of the liquid/granulate matter and the like. For example, for a user that wishes to store paint left overs in a plurality of storage containers 10, he may want to include information such as the room/wall where it was used, the date of purchase, the date of application, the exact color/finish of the product, recipe of the product and the like. The identification member may be included on the substantially flat bottom wall 16, or anywhere on the container body 12 and/or on the main lid 20. For example, the identification member may be a sleeve attached to the storage container 10, which allows the insertion of a paper-like material to write down the information required. Alternatively, the identification member may be a section where the user can write down the information and erase it at his convenience.

According to one embodiment, the internal volume defined by the container body 12 and the main lid 20 may be between about 100 mL and about 1000 mL or 100 mL and about 900 mL, or 100 mL and about 800 mL, or 100 mL and about 700 mL, or 100 mL and about 600 mL, or 100 mL and about 500 mL, 100 mL and about 400 mL, or 100 mL and about 300 mL, 100 mL and about 200 mL, or 100 mL and about 750 mL, or 100 mL and about 250 mL. For example, as shown in FIG. 1-19, the storage container 10 may provide an internal volume of about 650 mL. For another example, as shown in FIGS. 20-38, the storage container 10 may provide an internal volume of about 250 mL.

According to one embodiment, the diameter of the storage containers 10 described above may be between about 2 inches (about 5.1 cm) and about 6 inches (about 15.2 cm). More preferably, the diameter of the storage containers 10 described above may be about 4 inches.

It is to be noted that the size (i.e., volume, diameter, and the like) of the storage container 10 is important such as to provide to a user a storage container 10 with a size that is less than a paint gallon for example. Thus, the user will be able to recuperate the paint gallon for example, and to keep the left-over for touch-ups in a plurality of storage containers 10.

As shown, the storage containers 10 may be grouped in groups of two (FIG. 12), three (FIG. 17), six (FIG. 36) and the like, such as to stack the storage containers 10 altogether.

According to another embodiment and referring now to FIGS. 39-51, there is provided a storage system 50 for storing a liquid and/or a granulate matter. The storage system 50 includes one or more storage container(s) 10 as defined above and as shown in FIGS. 1-38, which define a top portion 56 and a bottom portion 58 configured for stacking, for storing the liquid and/or the granulate matter. The storage system 50 further includes a storage cabinet 52 which includes a floor member 54 that includes a stacking element 60 for stackably receiving the bottom portion 58 of the container body 12.

The stacking member 18 on the substantially flat bottom wall 16 of one storage container 10 is adapted for stacking with the main lid 20 of another storage container 10 and on the stacking element 60 on the floor member 54 of the storage cabinet 52.

As shown in FIGS. 39, 40, 48, 49, 50 and 51, the stacking element 60 also includes a circular outwardly projecting surface 62 for releasably interfacing with the circular recess 26 on the substantially flat bottom wall 16 of the container body 12 for stackably receiving the bottom portion 58 of the container body 12.

According to one embodiment, each one of the circular outwardly projecting surfaces 30, 62 on the main lid 20 and on the floor member 54 includes corresponding circular threads 36, 64 for releasably interfacing with the circular threads 34 on the substantially flat bottom wall 16 of the container body 12.

As show in FIGS. 39, 40, 46, 47 and 50, the floor member 54 of the storage cabinet 52 includes two stacking elements 60 for receiving a plurality of storage containers 12. Moreover, the storage cabinet 52 further includes a separation wall 66 which is substantially perpendicularly and upwardly extending from the floor member 54 for separating the two stacking elements 60. It is to be noted that a storage cabinet 52 may include a plurality of stacking elements 60 and/or a plurality of separation walls 66. The separation wall(s) 60 provides to the storage cabinet 52 and/or to the storage system 50 an additional solidity. Alternatively, the storage cabinet 52 may only include one stacking element 60.

According to one embodiment, the storage cabinet 52 may further include additional features such as wall member (s), door member (s), a handle member to transport the storage cabinet 52, a mounting system for mounting more than one storage cabinets 52 together and/or for mounting a storage cabinet 52 to a wall surface (i.e., the storage cabinet 52 may include holes 68 in a rear wall that can be used to attached the storage cabinet 52 to a surface using nails, screws and the like) and an additional identification member (not shown) for identifying the liquids and/or the granulate member contained in the storage containers 10 of the storage cabinet.

Figure 59:
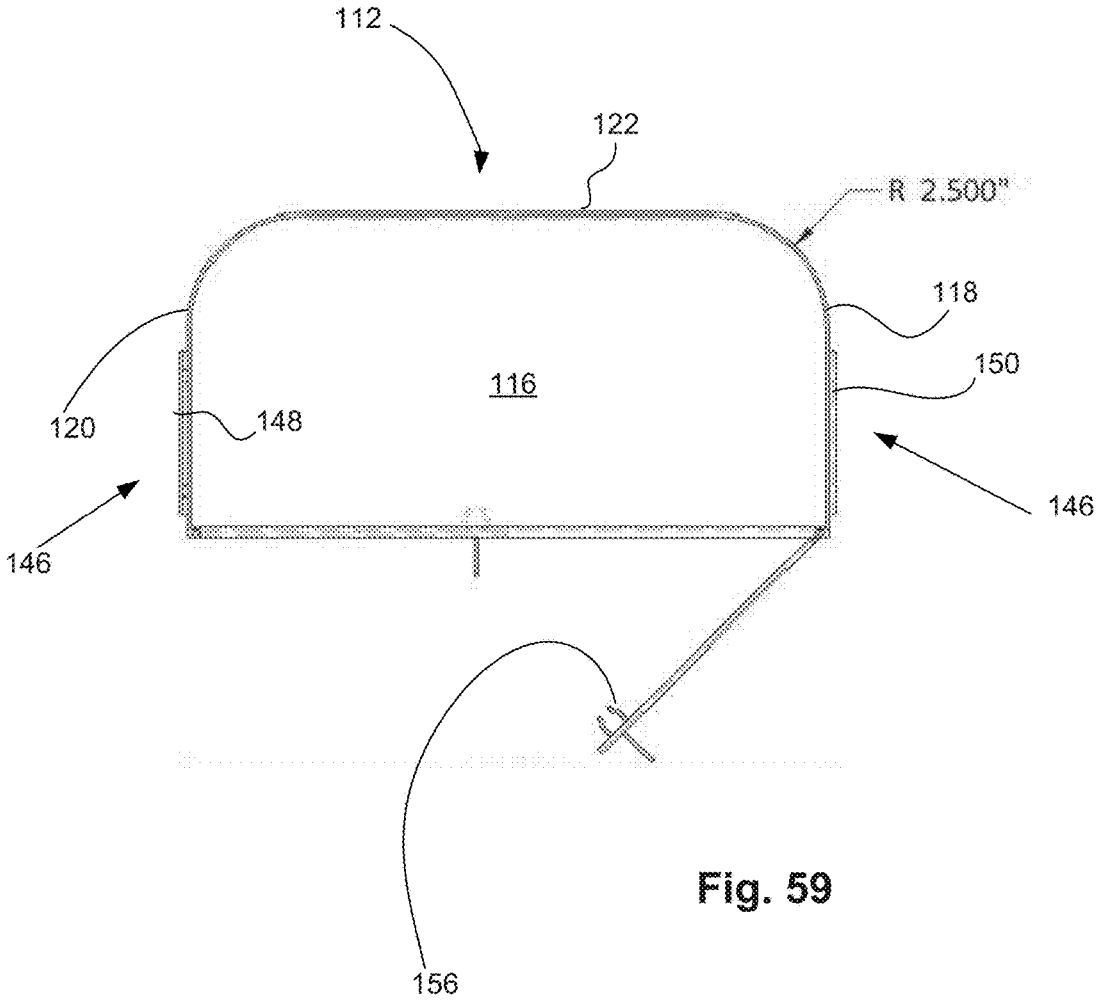
FIG. 59 is a top plan view of the storage cabinet of FIG. 54.
Figure 60:
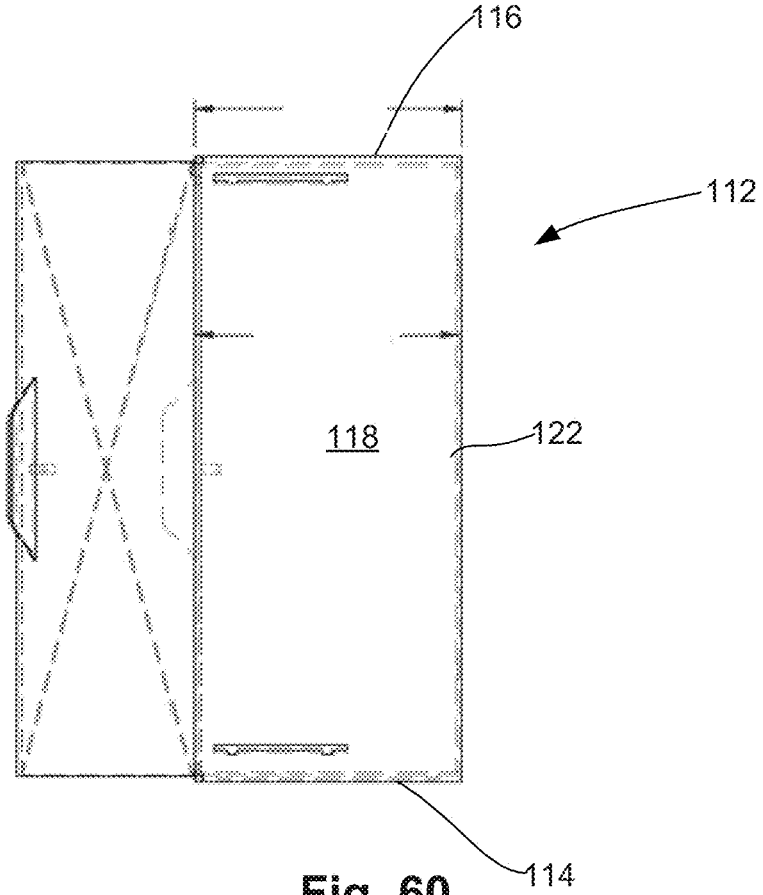
FIG. 60 is a side elevation view of the storage cabinet of FIG. 54.
Figure 61:
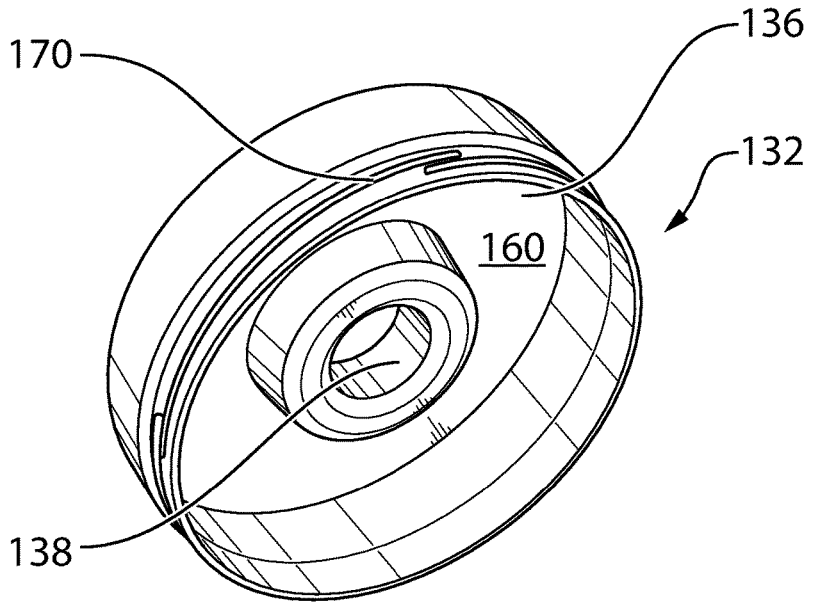
FIG. 61 is a top perspective view of a container body of a storage container in accordance with an embodiment.
Figure 62:
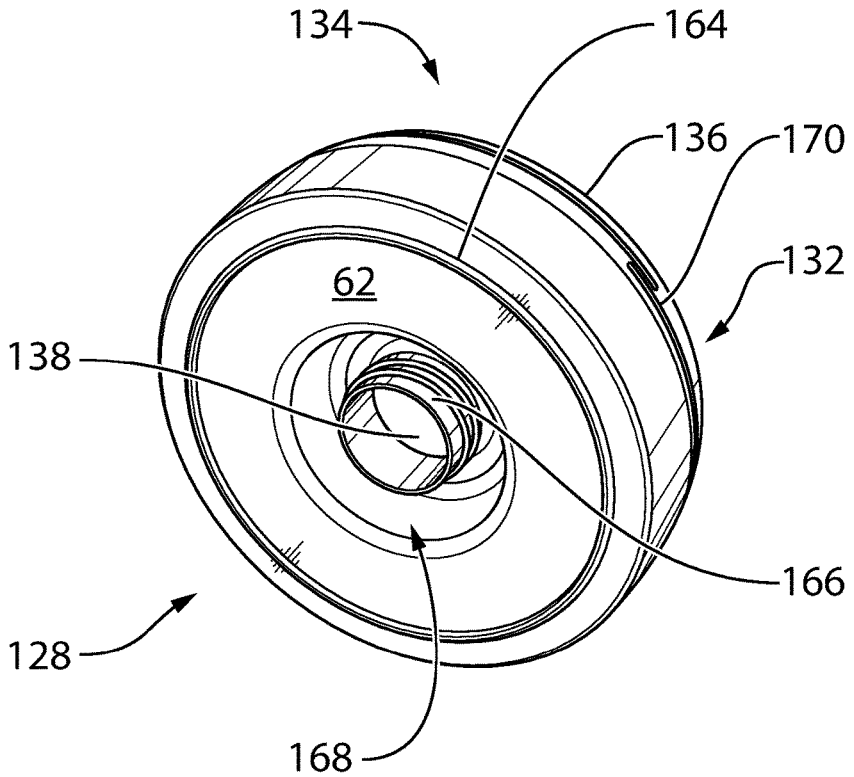
FIG. 62 is a bottom perspective view the container body of FIG. 61.
Figure 63:
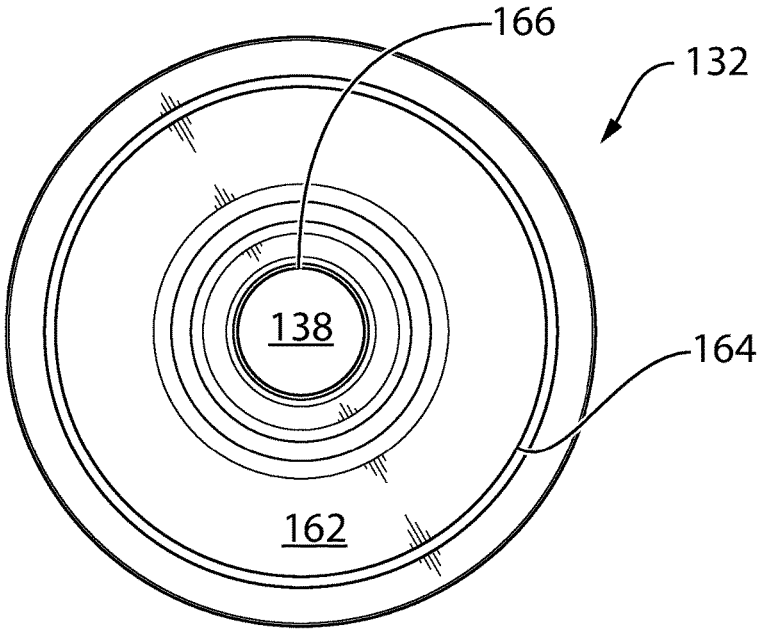
FIG. 63 is top plan view of the container body of FIG. 61.
Figure 64:
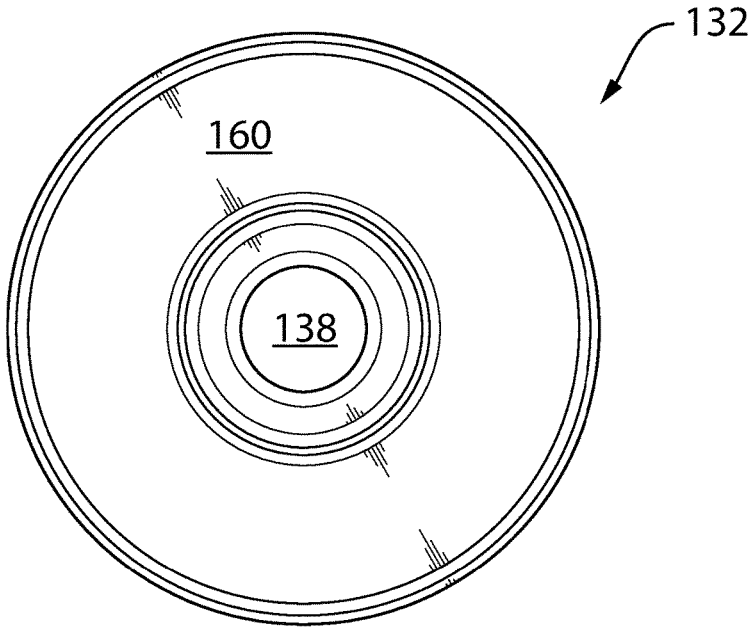
FIG. 64 is bottom plan view of the container body of FIG. 61.

Referring now to FIGS. 52-60, there is shown a storage system 110 for storing a liquid (i.e., paint, varnish liquids, polish liquids, dye products, chemical products, and the like). The storage system 110 includes a storage cabinet. As shown in FIGS. 52-60, the storage cabinets 112*a*, 112*b* include a floor member 114, a top member 116, two side walls 118, 120 and a rear wall 122 (FIG. 59). The storage cabinet 112 as shown further includes front doors 124*a*, 24*b* for giving access to one or a plurality of storage containers 130. The floor member 14 defines at least one stacking element or recess area 126 for receiving a bottom portion 128 of a container body 132 of a storage container 130. However, it is to be noted that the storage cabinet 112 may define any suitable size and configuration such as to at least receive a bottom portion 128 of a container body 132 in its stacking element or recess area 126. According to an embodiment, the storage cabinet 112 may only include a floor member 114 and two side walls 118, 120 of any length. According to another embodiment, the storage cabinet 112 may only include a floor member 114, front doors 124*a*, 124*b*, a rear wall 122 and two side walls 118, 120, without top member 116. According to an embodiment, the stacking element 126 may be of any size and configuration such as to be stackable with a bottom portion 128 of storage container 130. According to another embodiment, the stacking element 126 may be a projecting portion projecting from the floor member 114 such as to receive the bottom portion 128 of the storage container 130.

Still referring to FIGS. 52-60, the storage system 110 further includes one or a plurality of storage containers 130 (i.e., stackable storage container) for storing liquid.

Figure 52:
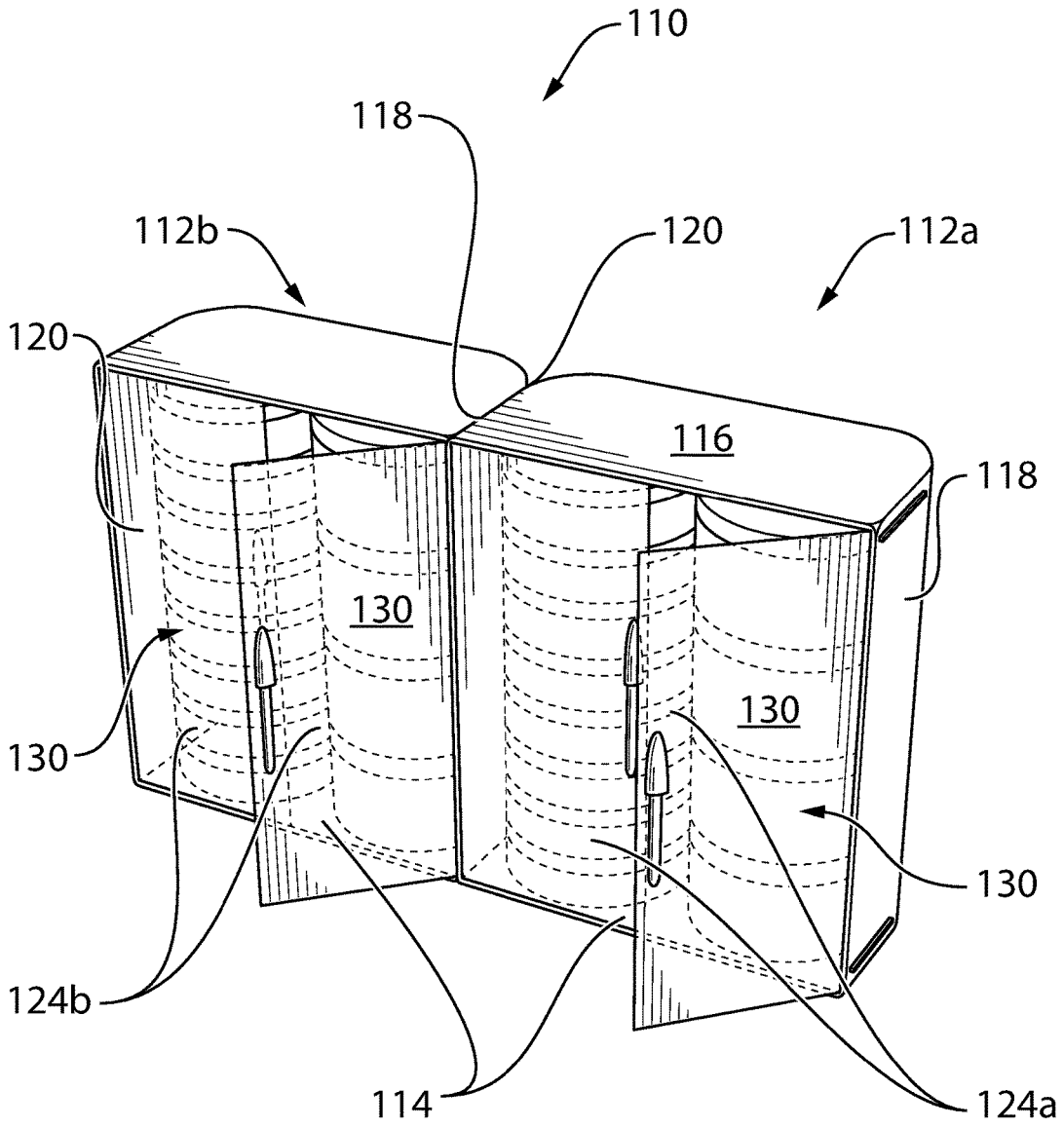
FIG. 52 is a top perspective view of a storage system in accordance with another embodiment.
Figure 53:
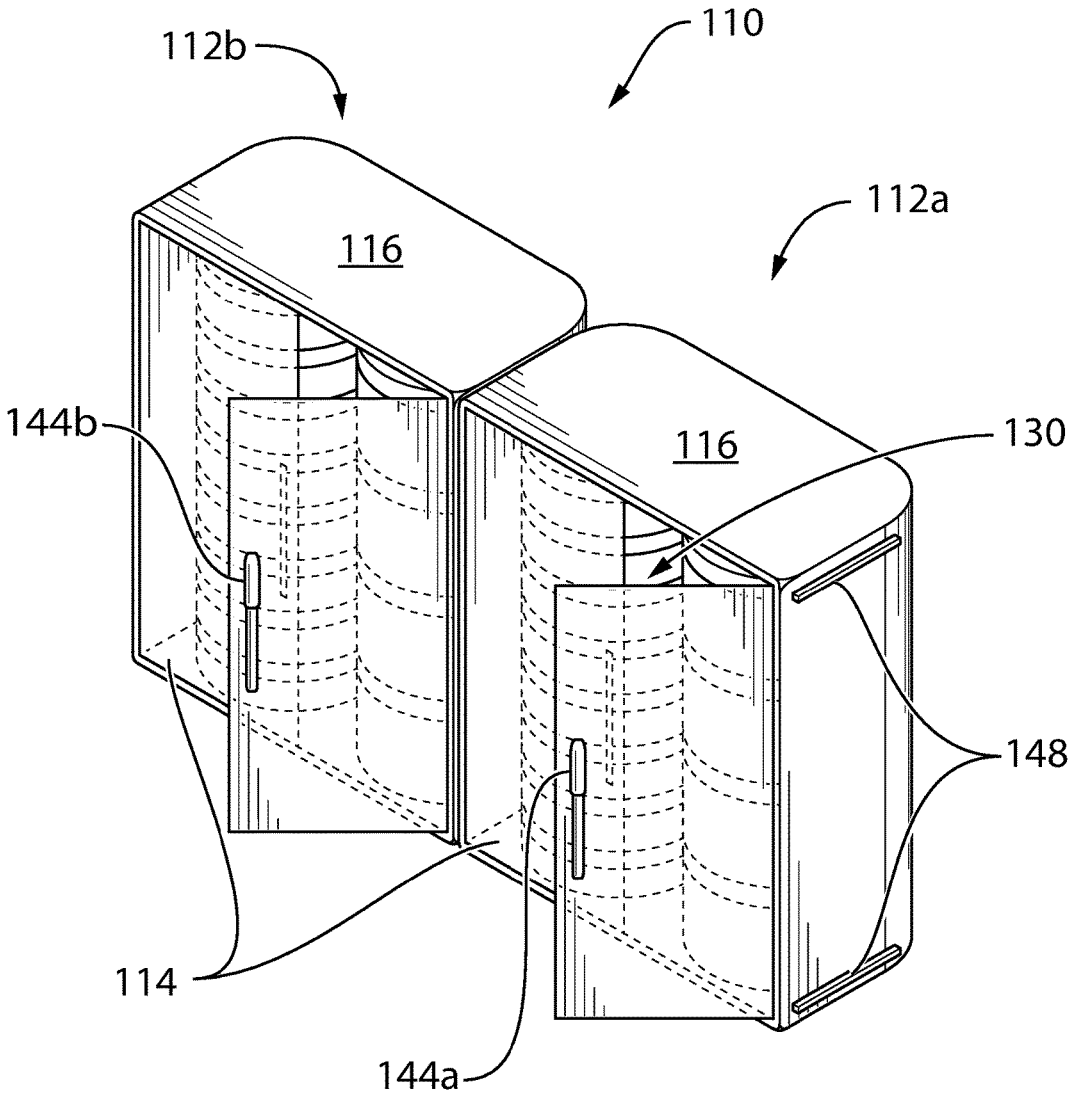
FIG. 53 is another perspective view of the storage system of FIG. 52.

As shown in FIGS. 52 and 53, the storage cabinet 112 may include one or a plurality of front doors 124*a*, 124*b*, such as glass doors, doors of a polymeric material and the like. According to another embodiment, the walls, top and floor members and doors of the storage cabinet 112 may be made of any suitable materials, such as, without limitation, metallic material, plastic materials, cardboard materials and the like.

The storage system 110, as shown in FIGS. 52 and 53, includes two storage cabinets 112*a*, 112*b* horizontally and releasably connected. According to another embodiment, the storage system 110 may include one, or more than one storage cabinets 112*a*, 112*b*. The storage cabinets 112*a*, 112*b* may be releasably connected together and/or fixedly connected together. Additionally, the storage cabinets 112*a*, 112*b* may be horizontally connected together, vertically connected or mounted together or both (i.e., a plurality of storage cabinets 112 horizontally connected together and a plurality of storage cabinets 112 vertically connected together).

Still referring to FIGS. 52 and 53, the storage system 110 further includes a touch-up tool (not shown), such as, without limitation, a paint brush, a paint roll, a pen and the like. According to an embodiment, the front doors 124*a*, 124*b* of the storage cabinets 112*a*, 112*b* may each further includes a handle 144*a*, 144*b* for allowing a user to reach the interior of the storage cabinets 112*a*, 112*b* easily.

Figure 54:
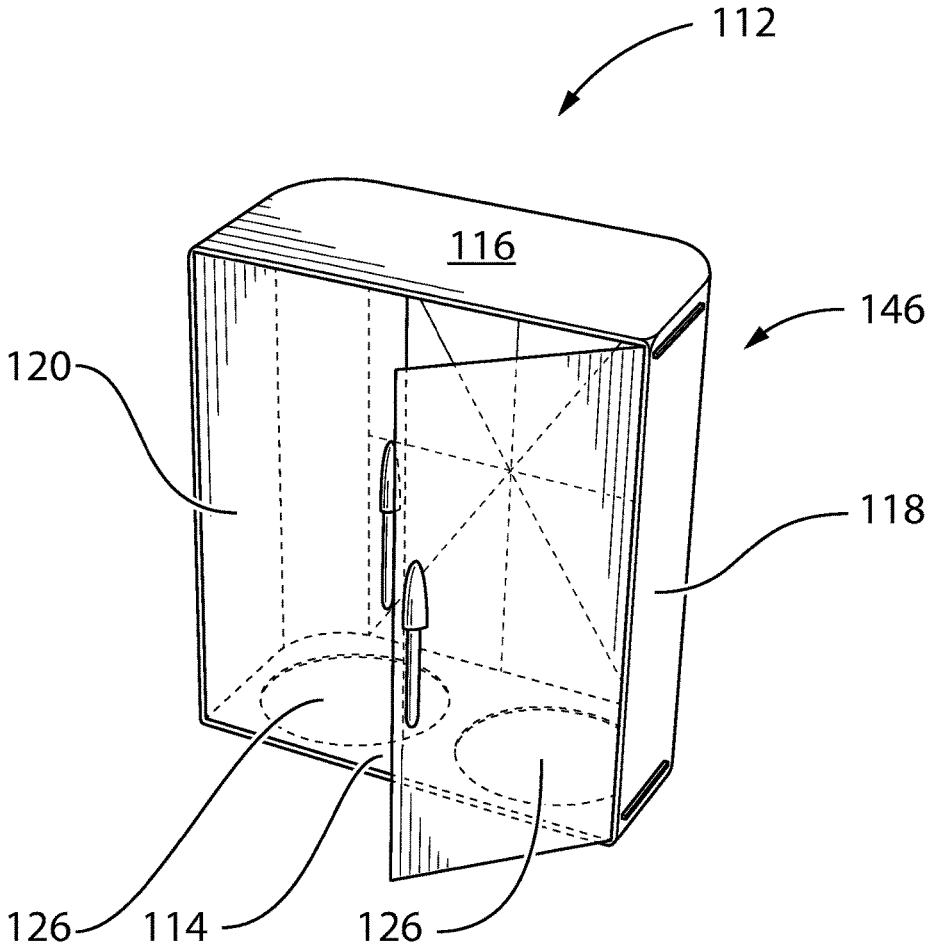
FIG. 54 is a top perspective view of a storage cabinet in accordance with another embodiment.

As better shown in FIG. 54, the recess area 126 defined by the floor member of the storage cabinet defines a surface area which substantially corresponds to the surface area defined by the bottom portion 128 of the storage container 130. The recess area 126 defined by the floor member 114 also substantially corresponds to the top portion 134 of the container body 132 such that a bottom portion 128 of the storage container 130 can interface with one of the recess area 126 of the floor member 114 and the top portion 134 of the storage container 130. As shown in FIG. 54, storage cabinet 112 includes two recess areas defined by the floor member 114. According to an embodiment, the storage cabinet 112 may include one or a plurality of recess areas 126, of any shape and configuration, aligned or not. According to another embodiment, the recess areas 126 may be squared or polygonal such as to receive a squared or polygonal container body 132 therein.

Figure 55:
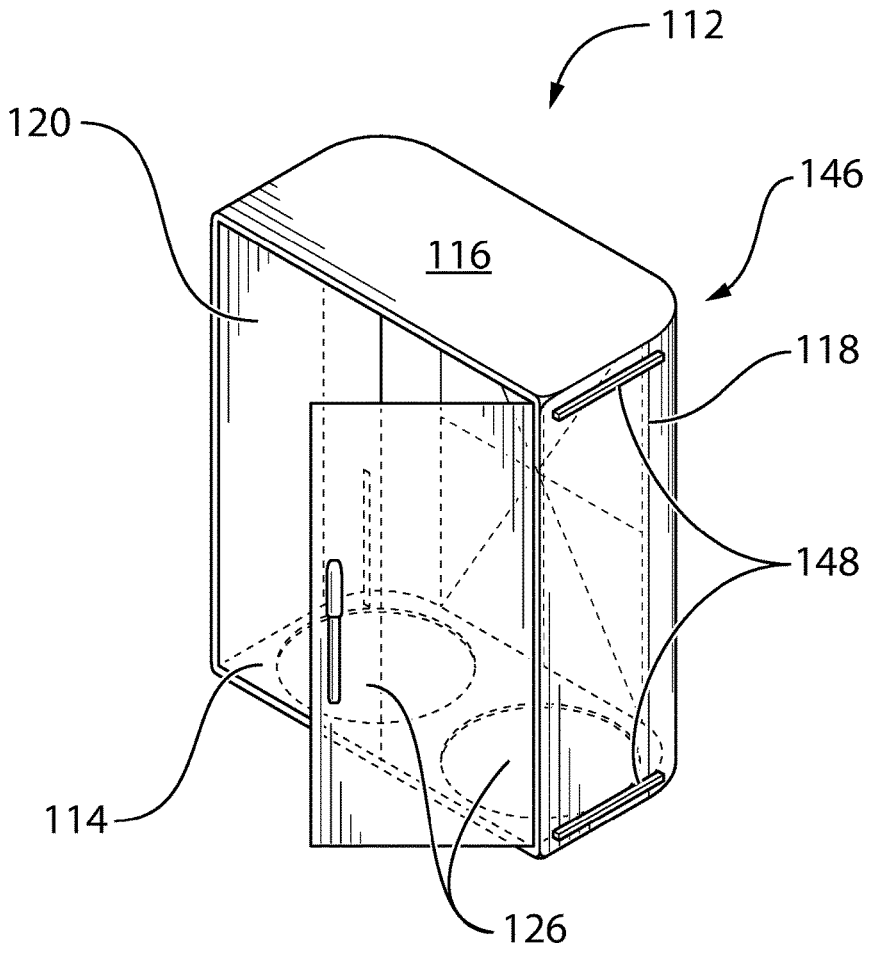
FIG. 55 is another perspective view of the storage cabinet of FIG. 54.

The storage cabinet 112 further includes an attachment system 146 to releasably or fixedly connecting storage cabinets 112*a*, 112*b* together. As better shown in FIG. 57, a side wall 118 of a first storage cabinet 112*a* includes a mating connector 148 for releasably or fixedly connecting with a corresponding mating connector 150 mounted on a side wall 120 of the second storage cabinet 112*b*. More particularly, the mating connector 148 of the attachment system 146 defines a downwardly projecting portion 152 and the corresponding mating connector 150 of the attachment system 146 defines a corresponding upwardly projecting portion 154 for releasably or fixedly interfacing with the downwardly projecting portion 152 of the mating connector 148. As shown in FIG. 55, storage cabinet 112 includes a mating connector 148 near the bottom of the side wall 118 and a mating connector 148 at the top of the side wall 118 such as to connect with corresponding mating connectors 150. According to an embodiment, the storage cabinet 112 may only include one mating connector 148 such as to connect with one corresponding mating connector 150 on another adjacent storage cabinet 112. According to another embodiment, it is to be noted that the attachment system 146 may also be positioned on the rear wall or on the top wall such as to releasable or fixedly, horizontally or vertically, connect two adjacent storage cabinets 112 together. According to another embodiment, it is to be noted that the mating connector 148 and the corresponding mating connector 150 may include any suitable mating connector for releasably or fixedly connecting a first storage cabinet 112 with a second storage cabinet 112.

Figure 56:
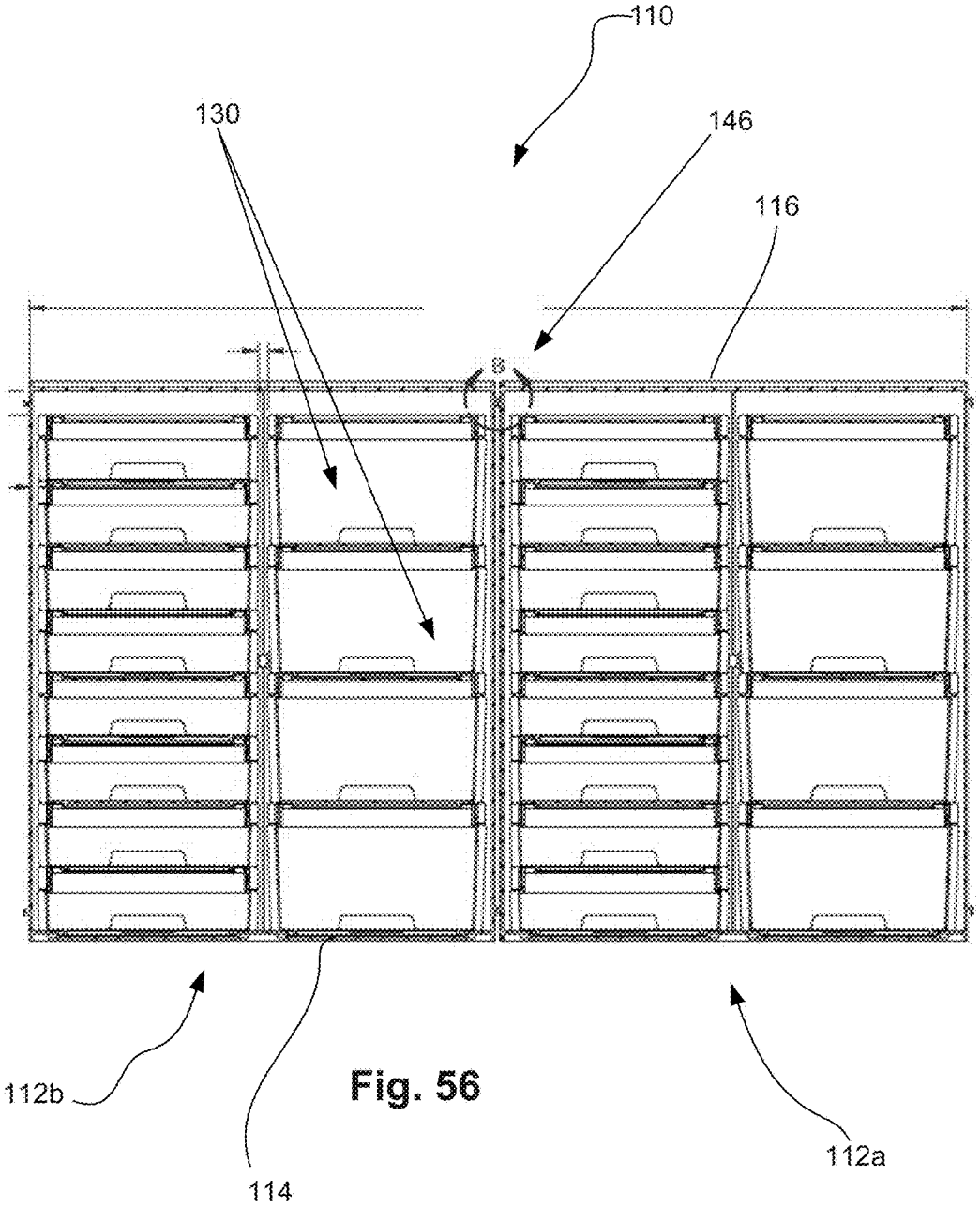
FIG. 56 is an elevation view of the storage system of FIGS. 52 and 53.
Figure 57:
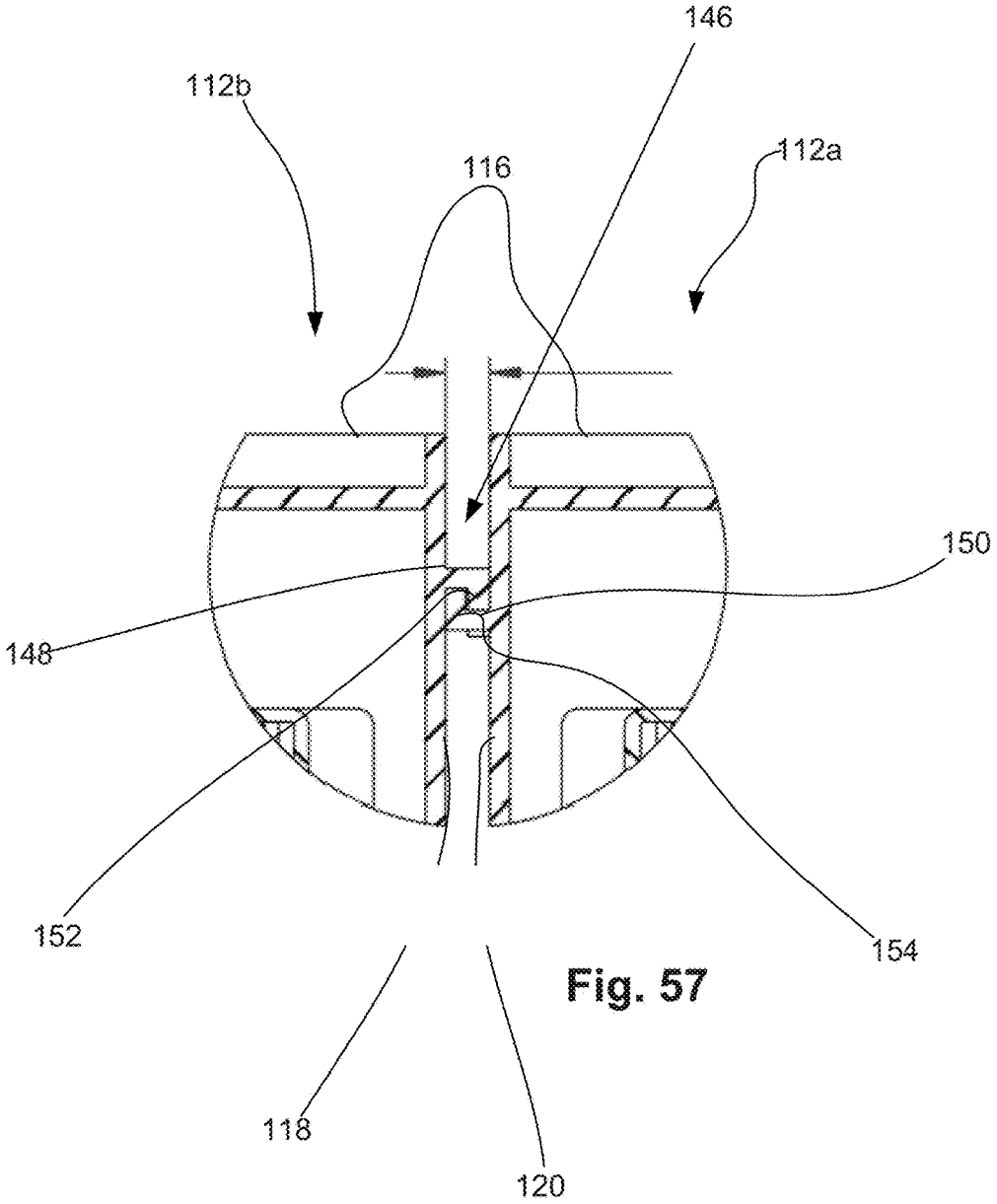
FIG. 57 is a close-up view of a connection system between two storage cabinets of the storage system of FIG. 56.
Figure 58:
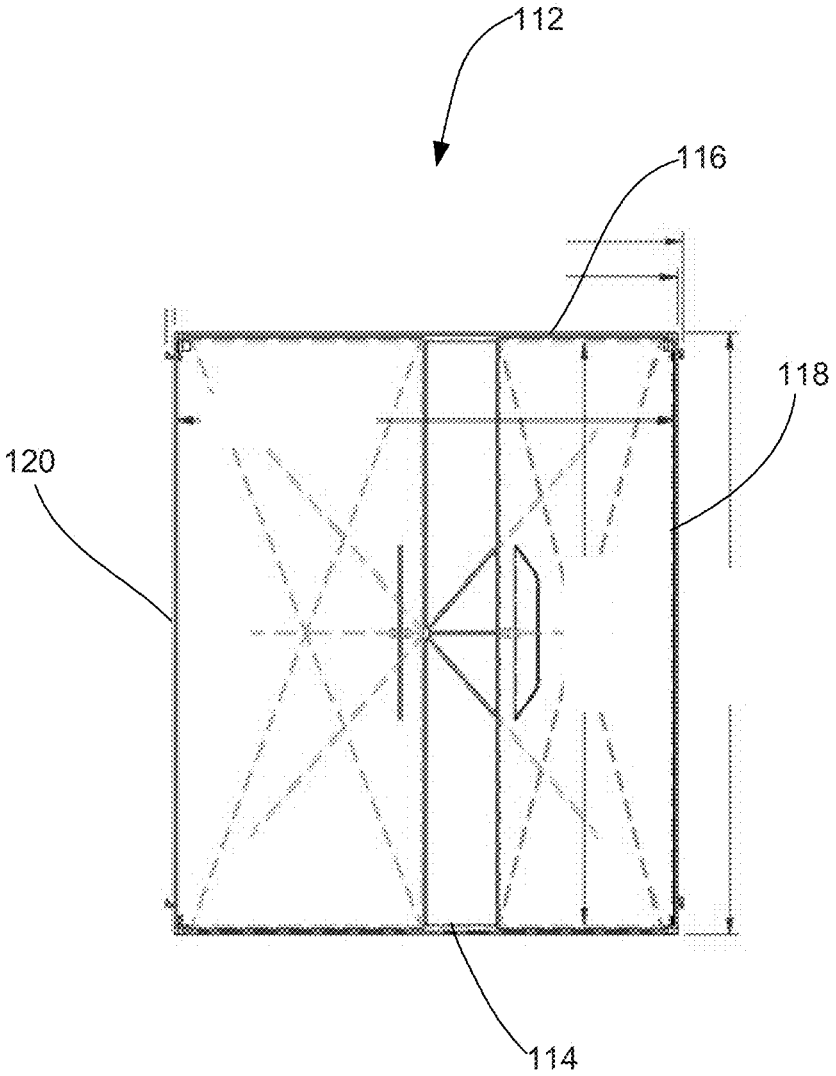
FIG. 58 is a front elevation view of the storage cabinet of FIG. 54.

FIG. 56 illustrates a storage system 110 which includes two storage cabinets 112*a*, 112*b* releasably and horizontally connected together via the attachment system 146 shown in FIG. 57 in accordance with another embodiment. According to another embodiment, the storage containers 130 may be of a squared shape and stackable. Also, some of the storage containers 130 define a greater height such as to be able to receive more liquid.

As shown in FIG. 59, the front door 124*a* and/or 124*b* of the storage cabinet 112 includes a hook 156 for releasably connecting with a paintbrush or a pen.

Now referring to FIGS. 61, 62, 63 and 64, there is shown a container body 132. A storage container 130 includes a container body 132 for storing the liquid. The container body 132 defines a top portion 134 with a main access 136 and a bottom portion 128 with a secondary access 138. The storage container 130 further includes a main lid 140 removably mounted to the top portion 134 of the container body 132 for covering the main access 136 and a secondary lid 142 removably mounted to the bottom portion 128 of the container body 132 for covering the secondary access 138. When the main lid 140 is removably mounted on the top portion 134 of the container body 132, the storage container 130 may receive a bottom portion 128 of another storage container 130 for stacking them together. Furthermore, when the secondary lid 142 is removably mounted on the bottom portion 128 of the container body 132, the storage container 130 may interface with one of a top portion 134 of the other storage container 130 and the recess area 126.

The container body 132 defines an interior surface 160 and an exterior surface 162. The exterior surface 162 includes a projecting lip 164 for allowing the bottom portion 128 of a storage container 130 to interface with a top portion 134 of another storage container 130 or to interface with the recess area 126 of the floor member 114. The secondary access 138 further includes a threaded edge 166 for surrounding the secondary access 138. The threaded edge 166 is for releasably mounting the secondary lid 142 to the bottom portion 128 of the container body 132. According to another embodiment, the threaded edge 166 may be embedded within a recessed space 168 defined by the exterior surface 162 such that the secondary lid 142 does not come below the exterior surface 162 of the container body 132. According to another embodiment, the container body 132 may further include another threaded edge 170 for surrounding the main access 136. The other threaded edge 170 is for releasably mounting the main lid 140 to the top portion 134 of the container body 132.

Figure 65:
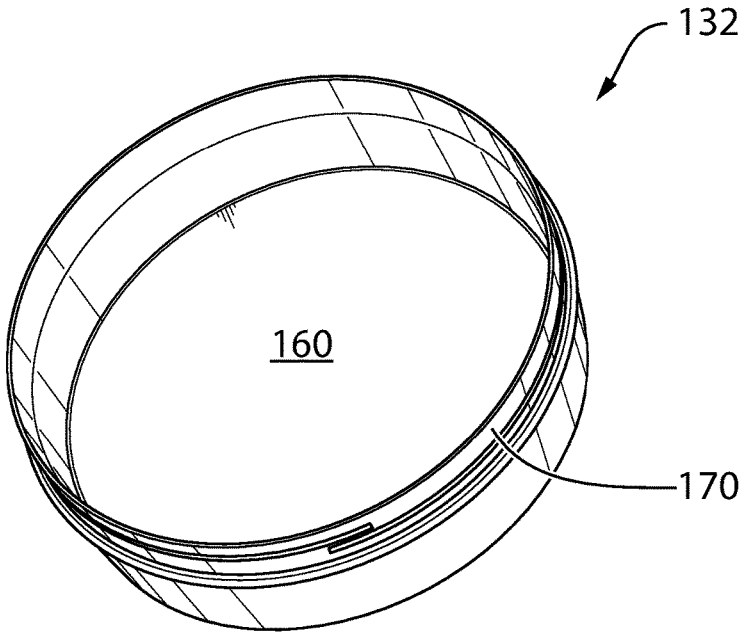
FIG. 65 is a top perspective view of a container body of the storage container in accordance with another embodiment.
Figure 66:
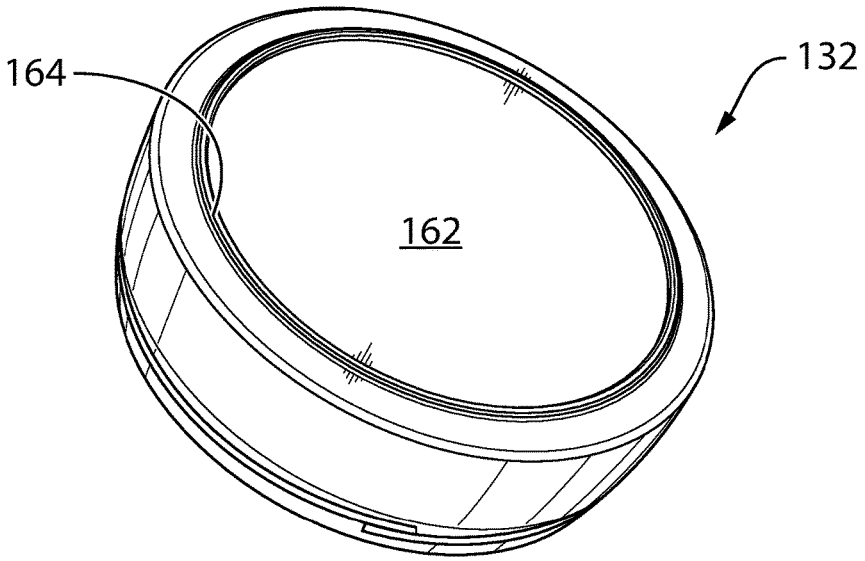
FIG. 66 is a bottom perspective view of the container body of FIG. 65.
Figure 67:
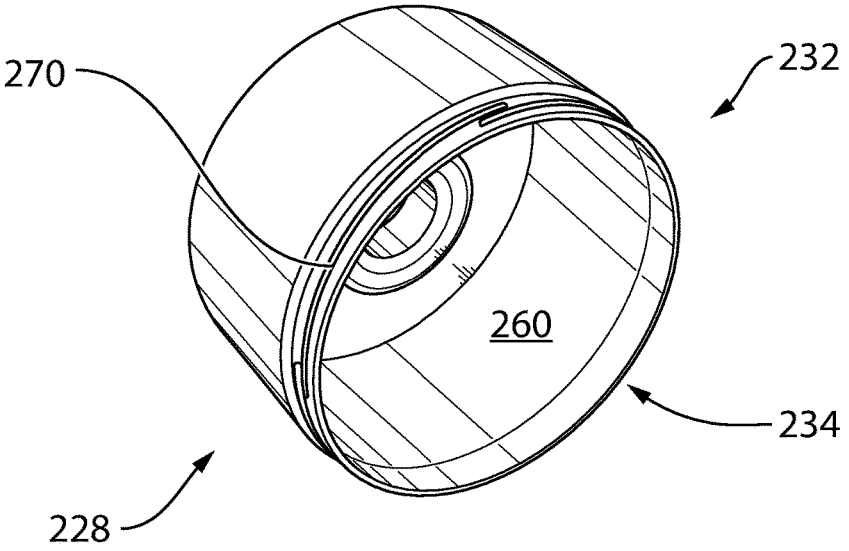
FIG. 67 is a top perspective view of a container body of a storage container in accordance with another embodiment.
Figure 68:
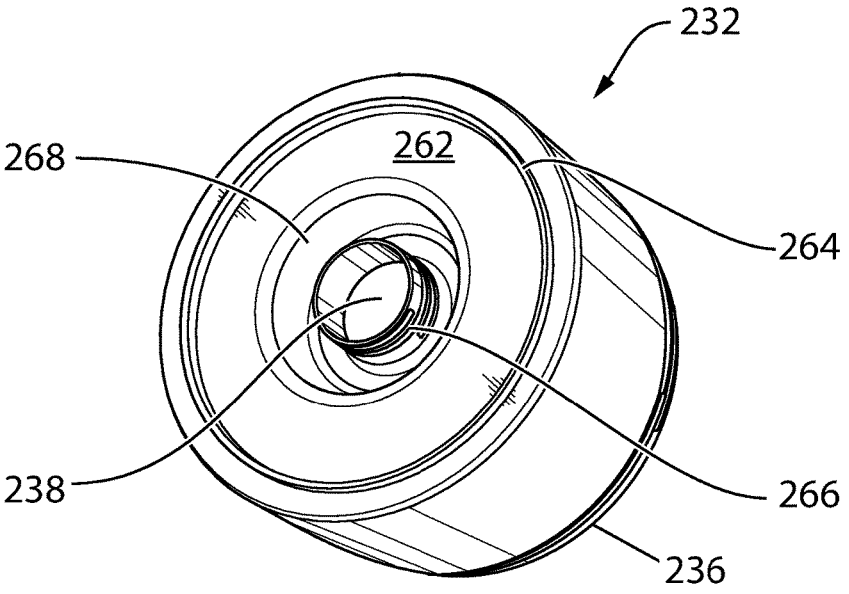
FIG. 68 is a bottom perspective view of the container body of FIG. 67.
Figure 69:
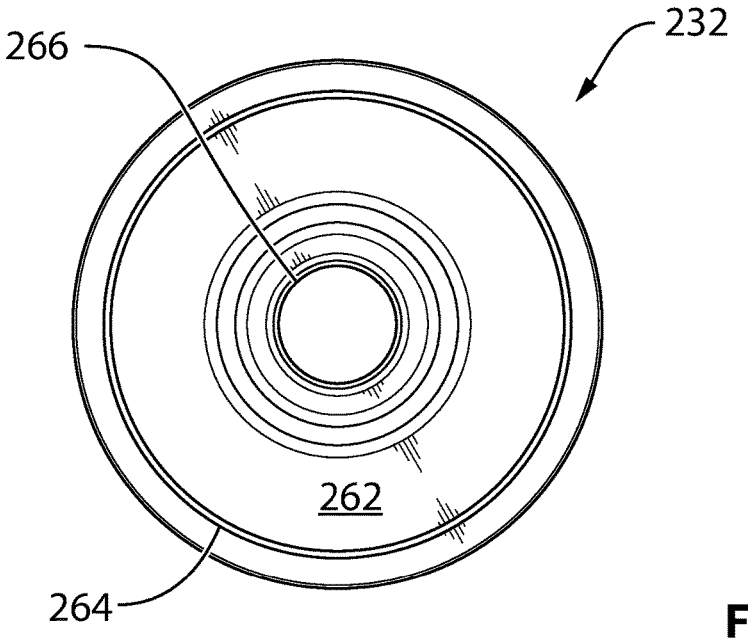
FIG. 69 is a bottom plan view of the container body of FIG. 68.
Figure 70:
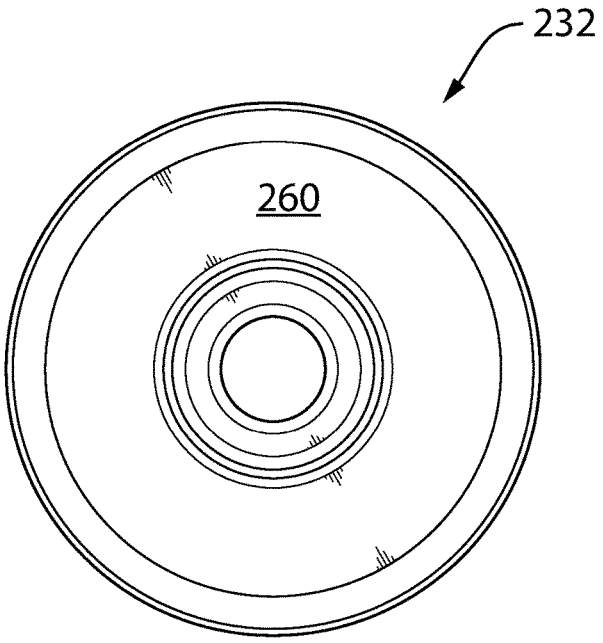
FIG. 70 is a top plan view of the container body of FIG. 67.

FIGS. 65 and 66 illustrate a container body 132 in accordance with another embodiment of the present invention. The container body 132 defines a main access 136 only. It is to be noted that the container body 132 defined by FIGS. 65 and 66 may be stackable with a plurality of other storage containers 130 which have both the main and the secondary lids 140, 142.

Now referring to FIGS. 67, 68, 69 and 70, there is shown a container body 232 in accordance with another body. The container body 232 of FIGS. 67, 17, 18 and 19 is configured to receive a larger volume of liquid (i.e., paint). The container body 232 defines an interior surface 260 and an exterior surface 262. The exterior surface 262 may include a projecting lip 164 for allowing the bottom portion 228 of a storage container 130 to interface with a top portion 234 of another storage container 130 or to interface with the recess area 226 of the floor member 114. The secondary access 238 further includes a threaded edge 266 for surrounding the secondary access 238. The threaded edge 266 is for releasably mounting the secondary lid 142 to the bottom portion 228 of the container body 232. According to another embodiment, the threaded edge 266 may be embedded within a recessed space 268 defined by the exterior surface 262 such that the secondary lid 142 does not come below the exterior surface 162 of the container body 232. According to another embodiment, the container body 232 may further include another threaded edge 270 for surrounding the main access 236. The other threaded edge 270 may be for releasably mounting the main lid 140 to the top portion 234 of the container body 232.

Figure 71:
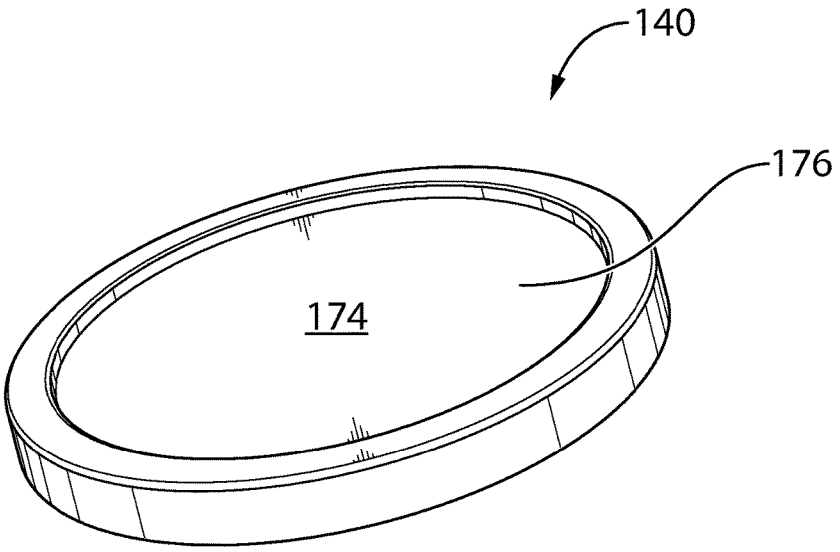
FIG. 71 is a top perspective view of a main lid of a storage container in accordance with another embodiment.
Figure 72:
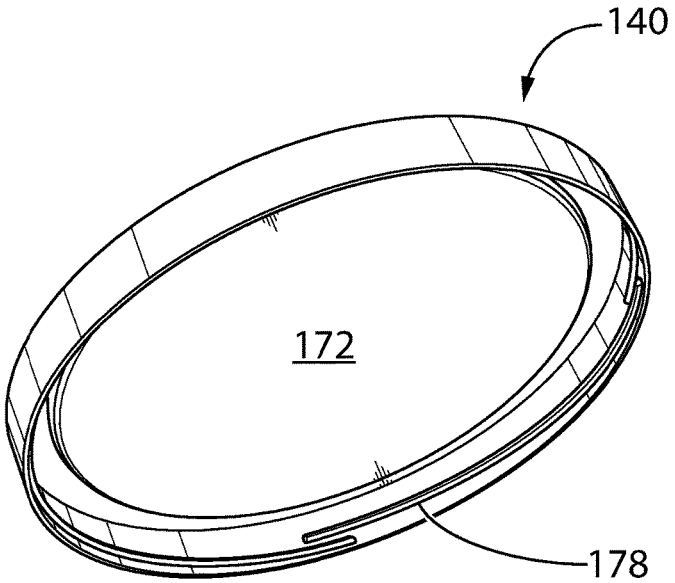
FIG. 72 is a bottom perspective view of the main lid of FIG. 71.
Figure 73:
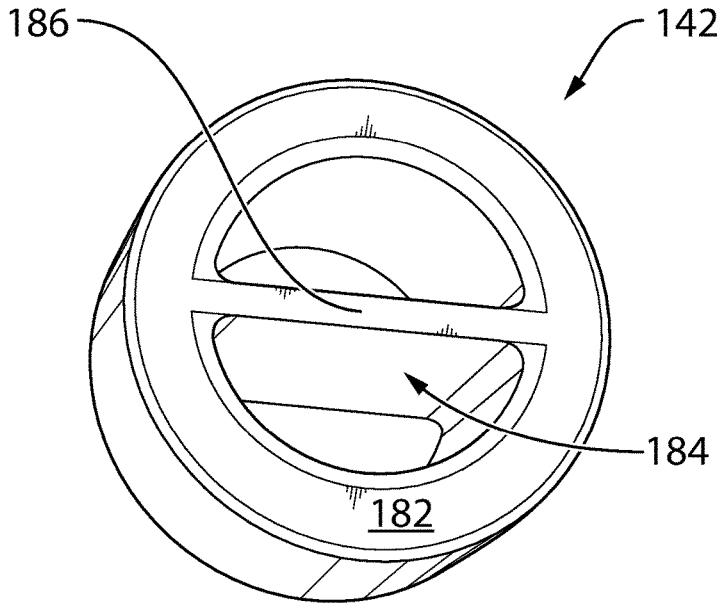
FIG. 73 is a top perspective view of a secondary lid of a storage container in accordance with another embodiment.
Figure 74:
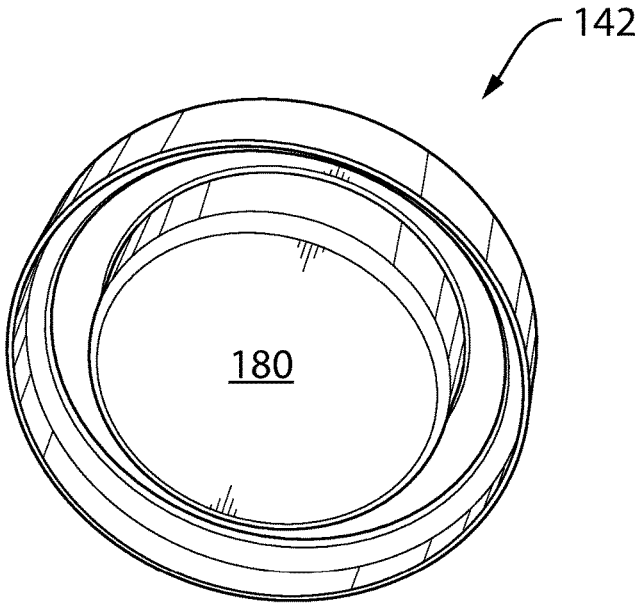
FIG. 74 is a bottom perspective view of the secondary lid of FIG. 73.
Figure 75:
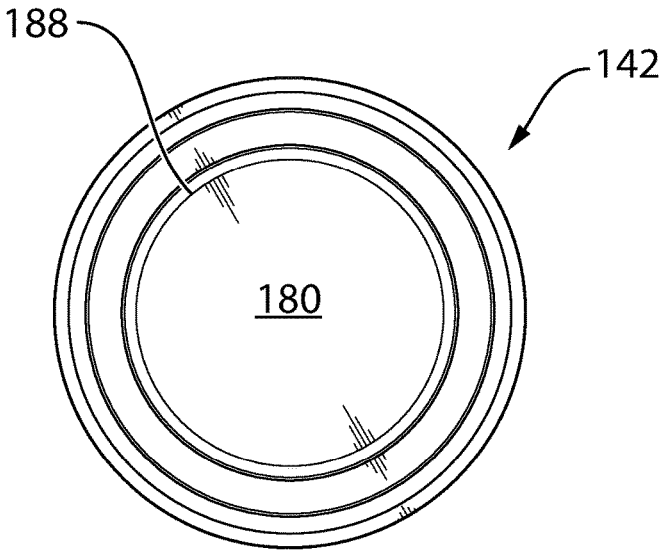
FIG. 75 is a bottom plan view of the secondary lid of FIG. 74.
Figure 76:
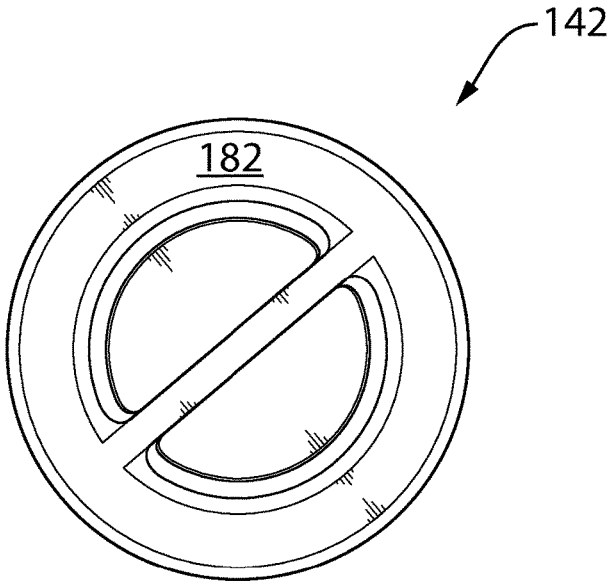
FIG. 76 is a top plan view of the secondary lid of FIG. 73.

FIGS. 71 and 72 illustrate the main lid 140 of the storage container 130. The main lid 140 defines an interior surface 172 and an exterior surface 174. The exterior surface 174 of the main lid 140 defines a recess area 176 for receiving a bottom portion 128 of a container body 132. According to another embodiment, the interior surface 172 of the main lid 140 includes a threaded edge 178 for releasably mounting the main lid 140 to the top portion 134 of the container body 132.

FIGS. 73-76 illustrate the secondary lid 142 of the storage container 130. The secondary lid 142 defines an interior surface 180 and an exterior surface 182. The exterior surface 182 of the secondary lid 142 defines a recess area 184 and/or a handle portion 186 for allowing a user to release the secondary lid 142 from the container body 132. The interior surface 180 of the secondary lid 142 further includes a corresponding threaded edge 188 for releasably mounting the secondary lid 142 with the container body 132.

The storage containers and the storage system as described above are best used for storing left over painting but can be used for storing any suitable liquid or semi liquid substances. It is to be noted that the storage containers described above may include transparent sections, translucent sections, opaque sections and/or a combination of different sections. One of the features of the storage systems and storage containers described above is that the storage containers are stackable one over the other and that the plurality of stacked storage containers may be stacked on the floor members of the storage cabinets. The storage systems and storage containers may be of any suitable configuration such that they allow the storage containers to be stackable with other and that the containers are stackable within the storage cabinets. More particularly, the storage containers may be of a cylindrical shape for convenience of the users.

According to an embodiment, the main and secondary lids 140, 142 are of a flat surface such that they can receive a label (not shown) on which information about the liquid (i.e., color, year, room of the house covered, date, additional comments and the like) can be added.

According to an embodiment, the storage containers may include the following shapes and configurations:

Rounded container body 132; Diameter: 6.5 inches (about 16.5 cm); Height: 2 inches (about 5.1 cm); with or without a secondary lid 142;

Squared container body 132; Diagonal diameter: 6.5 (about 16.5 cm) inches; Height: 2 inches (about 5.1 cm); with or without a secondary lid 142;

Rounded container body 132; Diameter: 6.5 inches (about 16.5 cm); Height: 4 inches (about 10.2 cm); with or without a secondary lid 142;

Squared container body 132; Diagonal diameter: 6.5 inches (about 16.5 cm); Height: 2 inches (about 5.1 cm); with or without a secondary lid 142;

The storage systems and storage containers described above may provide the following advantages:

Even if after storing paint in a container body there still remain paint in the paint container, the user can recycle the remaining paint at a disposal center for example;

The storage containers and storage systems may include transparent portions for allowing a quick visualization of the remaining liquids or paint;

The storage containers and storage systems are smaller in size compared to a plurality of paint containers or paint cans;

The storage containers and storage systems have a nicer esthetic advantage compared to the paint containers in a garage;

The storage containers are stackable and the stackable storage containers are also stackable in the storage cabinets;

The storage containers may define the same shape of a paint container;

One storage container may have half the height of another storage container for allowing a perfect storage of the storage containers within the storage cabinet;

The main lid has the width of the container body such that the transfer of liquid to the container body is quick, clean and easy;

The secondary lid provides rapid access to the interior of the container body for small and quick touch-ups;

The storage cabinets may include about 8 to 16 storage containers at the same time;

The recess area or the stacking member defined within the floor member of the storage cabinet perfectly receives the bottom portion of the storage container, therefore providing a secure storage of the liquids.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A storage system for storing at least one of a liquid and a granulate matter, the storage system comprising:

at least one storage container for receiving the at least one of the liquid and the granulate matter comprising:

a container body having a main access and a principally flat bottom wall extending in a bottom of the container body and comprising a recess by a periphery of the principally flat bottom wall and defining an edge between the recess and the periphery, the edge being inclined with respect to the principally flat bottom wall and having a height small enough to keep the principally flat bottom wall at an elevation that is not substantially more than a thickness of the principally flat bottom wall;

a main lid removably mounted to the container body for covering the main access; and a secondary lid removably mounted to one of the container body and the main lid for covering a secondary access on the one of the container body and the main lid;

wherein the main lid comprises a first stacking element comprising a projection having an edge that is inclined to conform to the edge of the recess and to provide stacking; and a storage cabinet having a floor member comprising a second stacking element that has substantially the same shape as the first stacking element of the main lid, the second stacking element being for stackably receiving the bottom portion of the container body.

2. The storage system of claim 1, wherein the principally flat bottom wall comprises a stacking member configured for stacking with one of: a stacking element that has substantially the same shape as the first stacking element and the second stacking element.

3. The storage system of claim 2, wherein the secondary lid is removably mounted to the main lid for covering the secondary access on the main lid.

4. The storage system of claim 2, wherein the stacking member comprises a circular recess on a periphery of the principally flat bottom wall and the main lid comprises a circular outwardly projecting surface on a corresponding periphery of the main lid for releasably interfacing with the circular recess.

5. The storage system of claim 4, wherein each one of the first stacking element and the second stacking element comprises another circular outwardly projecting surface for releasably interfacing with the circular recess for stackably receiving the bottom portion of the container body.

6. The storage system of claim 4, wherein the circular recess on the periphery and the circular outwardly projecting surfaces each comprise circular threads for interfacing with each other.

7. The storage system of claim 4, wherein the secondary lid comprises a top surface below the circular outwardly projecting surface, for receiving the principally flat bottom wall of the container body.

8. The storage system of claim 4, wherein the main lid further comprises a recess between the secondary lid and the circular outwardly projecting surface.

9. The storage system of claim 1, wherein the floor member comprises a plurality of stacking elements for receiving a plurality of storage containers.

10. The storage system of claim 9, wherein the storage cabinet further comprises a separation wall substantially perpendicular to and extending upwardly from the floor member, for separating at least two of the plurality of stacking elements.

11. The storage system of claim 1, wherein the storage cabinet further comprises a mounting system for mounting more than one storage cabinets together.

* * * * *